US010891896B2

(12) United States Patent
Wu

(10) Patent No.: US 10,891,896 B2
(45) Date of Patent: Jan. 12, 2021

(54) DISPLAY DEVICE AND DRIVING METHOD FOR DISPLAY DEVICE

(71) Applicant: Japan Display Inc., Tokyo (JP)

(72) Inventor: Ilin Wu, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/570,088

(22) Filed: Sep. 13, 2019

(65) Prior Publication Data

US 2020/0005714 A1 Jan. 2, 2020

Related U.S. Application Data

(63) Continuation of application No. PCT/JP2018/000684, filed on Jan. 12, 2018.

(30) Foreign Application Priority Data

Mar. 16, 2017 (JP) ..... 2017-051613

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01); *G09G 2300/0852* (2013.01)

(58) Field of Classification Search
CPC ..... G09G 3/3233; G09G 3/3266; G09G 2300/0426; G09G 2300/0852
See application file for complete search history.

(56) References Cited

U.S. PATENT DOCUMENTS

| | | | | |
|---|---|---|---|---|
| 10,366,652 | B2 * | 7/2019 | Hwang | G09G 3/3233 |
| 2007/0195020 | A1 | 8/2007 | Nathan et al. | |
| 2015/0187272 | A1 | 7/2015 | Kimura et al. | |
| 2016/0275870 | A1 | 9/2016 | Kimura et al. | |

FOREIGN PATENT DOCUMENTS

| | | | |
|---|---|---|---|
| JP | 2009-169145 | A | 7/2009 |
| JP | 2009-526248 | A | 7/2009 |
| JP | 2009-282191 | A | 12/2009 |
| JP | 2010-128183 | A | 6/2010 |
| JP | 2012-068662 | A | 4/2012 |

(Continued)

OTHER PUBLICATIONS

International Search Report dated Apr. 10, 2018 for the PCT application No. PCT/JP2018/000684. With English Translation.

(Continued)

*Primary Examiner* — Michael Pervan
(74) *Attorney, Agent, or Firm* — Michael Best & Friedrich LLP

(57) ABSTRACT

A display device includes a first pixel arranged with a first light emitting element having a first pixel electrode and a common electrode, and a drive transistor having an input/output terminal, one end of the input/output terminal being connected to the first pixel electrode, and a second pixel adjoins the first pixel electrode, and is arranged with a second light emitting element having a second pixel electrode and the common electrode, wherein the first pixel electrode and the second pixel electrode are connected via first switch.

7 Claims, 15 Drawing Sheets

(56) References Cited

FOREIGN PATENT DOCUMENTS

| | | | |
|---|---|---|---|
| JP | 2013-122481 | A | 6/2013 |
| JP | 2014-085384 | A | 5/2014 |
| JP | 2015-125366 | A | 7/2015 |
| JP | 2016-177049 | A | 10/2016 |

OTHER PUBLICATIONS

Written Opinion of the International Searching Authority dated Apr. 10, 2018 for the PCT application No. PCT/JP2018/000684.
Written Opinion of the International Searching Authority dated Apr. 10, 2018 for the PCT application No. PCT/JP2018/000684, with English translation.

* cited by examiner

DISPLAY DEVICE AND DRIVING METHOD FOR DISPLAY DEVICE

CROSS REFERENCE TO RELATED APPLICATIONS

This application is based upon and claims the benefit of priority from the prior Japanese Patent Application No. 2017-051613, filed on Mar. 16, 2017, and PCT Application No. PCT/JP2018/000684 filed on Jan. 12, 2018, the entire contents of which are incorporated herein by reference.

FIELD

An embodiment of the present invention relates to a display device and a driving method for a display device.

BACKGROUND

An organic electroluminescence display device (EL display device) is formed from a plurality of transistors, capacitors, and an organic light emitting element (hereinafter referred to as a light emitting element) which are include in each of a plurality of pixels formed on a substrate. Each pixel is driven by a signal that controls the pixel. By controlling driving of a transistor included in each pixel using a signal, a current (hereinafter, referred to as a light emitting current) supplied to the light emitting element is controlled. As a result, the display device can display an image. In recent years, the demand for finely displaying images has been increasing. That is, the demand for higher definition of a display device is increasing. In order to realize high definition, it is necessary to reduce the size of the pixel. In an EL display device, for example, color display can be performed by using a color filter corresponding to three primary colors of RGB and a white light emitting element. In addition, in the EL display device, there is no need to separately apply the RGB colors, and there is no need to worry about positional accuracy. An EL display device provides a high definition display device. In addition, in an EL display device in which the light emitting layer of the light emitting element is separately formed for each pixel, a technology has been developed for applying and arranging the organic material of the light emitting layer so as to reduce the pixel size and for high definition. Furthermore, the driving method of the EL display is required to be adapted to high definition of the display device.

For example, Japanese Unexamined Patent Application Publication No. 2013-122481 discloses a pixel circuit arranged with two transistors, two capacitor elements, and one light emitting element, a display device including the pixel circuit, and a driving method. Japanese Unexamined Patent Application Publication No. 2014-85384 discloses a pixel circuit arranged with three transistors, three capacitor elements, and one light emitting element, a display device including the pixel circuit, and a driving method.

As is disclosed in Japanese Unexamined Patent Application Publication No. 2013-122481 and Japanese Unexamined Patent Application Publication No. 2014-85384, a pixel included in an EL display device requires a plurality of transistors and a capacitor element. The EL display device can be expected to have high definition. On the other hand, in a high definition EL display device, the size of the pixel is reduced and the size of each element must also be reduced. Consequently, the size of a capacitor element included in one pixel is also reduced, and the capacitance value of the capacitor element is also reduced. That is, the maximum value of the storage capacitance which can be stored by one pixel is reduced. As a result, in an EL display device, the maximum value of a light emitting current which can be supplied to a light emitting element is reduced, which may cause a decrease in dynamic range. In addition, the image quality of the EL display device may be degraded.

SUMMARY

One embodiment of the present invention is a display device including a first pixel arranged with a first light emitting element having a first pixel electrode and a common electrode, and a drive transistor having an input/output terminal, one end of the input/output terminal being connected to the first pixel electrode, and a second pixel adjoins the first pixel electrode, and is arranged with a second light emitting element having a second pixel electrode and the common electrode, wherein the first pixel electrode and the second pixel electrode are connected via at least one first switch.

One embodiment of the present invention is a driving method of a display device including applying an initial potential to a gate of a first drive transistor in which one input/output terminal is electrically connected with a first terminal of a first light emitting element in a first pixel arranged with the first light element, and applying an initial potential to a gate of a second drive transistor in which one input/output terminal is electrically connected with a first terminal of a second light emitting element in a second pixel arranged with the second light element, applying a power supply voltage to a second input/output terminal of the first drive transistor, electrically connecting the a first terminal of the first light emitting element with the a first terminal of the second light emitting element, applying a gate voltage according to a video signal input to the first pixel to the gate of the first drive transistor, blocking an electrical connection between the first light emitting element and the second light emitting element, and providing a current to the first light emitting element according to the gate voltage in a state where a power supply voltage is applied to a second terminal of the first drive transistor.

One embodiment of the present invention is a method for driving a display device, the display device comprising a first pixel and a second pixel adjoining the first pixel, the first pixel and the second pixel each include a drive transistor, a light emitting element, an additional capacitor, a second switch, a capacitor element, a fourth switch, a fifth switch and a power supply line, a first input/output terminal of the drive transistor, a first terminal of the light emitting element and a first terminal of the additional capacitor are electrically connected, the second switch is connected with a gate of the drive transistor, a first terminal of the capacitor element is electrically connected with a gate of the drive transistor, a first terminal of the fourth switch is electrically connected with the other terminal of the capacitor element, a first terminal of the light emitting element and a first terminal of the additional capacitor, a second terminal of the fifth switch is electrically connected with a first input/output terminal of the drive transistor, a first terminal of the fifth switch is electrically connected with a power supply line, and a first switch electrically connecting a first terminal of a light emitting element included in the first pixel, a first terminal of an additional capacitor included in the first pixel, a first terminal of a light emitting element included in the second pixel, and a first terminal of an additional capacitor included in the second pixel, the method comprising turning on the first switch to electrically connect one terminal of a light emitting element of the first pixel and one terminal of an additional capacitor of the first pixel and one terminal of a light emitting element of the second pixel and one terminal of an additional capacitor of the second pixel, simultaneously applying an initialization potential to a gate of a drive transistor of the first pixel when a second switch of the first pixel is in an ON state, applying an initialization potential to a gate of the drive transistor of the second pixel when a second switch of the second pixel is in an ON state, and applying a reset potential to one input/output terminal of a drive transistor of the first pixel when a fourth switch of the first pixel is in an ON state, and applying a reset potential to one input/output terminal of a drive transistor of the second pixel when a fourth switch of the second pixel is in an ON state, simultaneously switching the state of a fourth switch of the first pixel to an OFF state and switching the state of a fourth switch of the second pixel to an OFF state, applying a power supply voltage to a second input/output terminal of the drive transistor of the first pixel by switching a fifth switch of the first pixel to an ON state, setting a potential between one input/output terminal and a gate of a drive transistor of the first pixel to a threshold voltage of a drive transistor of the first pixel, switching a second switch of the first pixel to an OFF state, applying a voltage according to a video signal to a gate of a drive transistor of the first pixel when a second switch of the first pixel is set to an ON state in a state where a light emitting element of the first pixel and a light emitting element of the second pixel are connected state, switching a second switch of the first pixel to an OFF state, blocking an electrical connection between a light emitting element of the first pixel and an additional capacitor of the first pixel, and a light emitting element of the second pixel and an additional capacitor of the second pixel by switching the first switch to an OFF state, and providing a current according to a gate voltage of a drive transistor of the first pixel to a light emitting element of the first pixel in a state where a power supply voltage is applied to the other input/output terminal of a drive transistor of the first pixel.

One embodiment of the present invention is a method for driving a display device, the display device comprising a first pixel and a second pixel adjoining the first pixel, the first pixel and the second pixel each include a drive transistor, a light emitting element, an additional capacitor, a second switch, a capacitor element, a third switch, a fourth switch, a fifth switch and a power supply line, a first input/output terminal of the drive transistor, a first terminal of the light emitting element and a first terminal of the additional capacitor are electrically connected, the second switch is connected with a gate of the drive transistor, a first terminal of the capacitor element is electrically connected with a gate of the drive transistor, a first terminal of the third switch is electrically connected with a gate of the drive transistor and a first terminal of the capacitor element, a first terminal of the fourth switch is electrically connected with the other terminal of the capacitor element, a first terminal of the light emitting element and a first terminal of the additional capacitor, a second terminal of the fifth switch is electrically connected with a second input/output terminal of the drive transistor, a first terminal of the fifth switch is electrically connected with a power supply line, and a first switch electrically connecting a first terminal of a light emitting element included in the first pixel, a first terminal of an additional capacitor included in the first pixel, a first terminal of a light emitting element included in the second pixel, and a first terminal of an additional capacitor included in the second pixel, the method comprising turning on the first switch to electrically connect one terminal of a light emitting element of the first pixel and one terminal of an additional capacitor of the first pixel and one terminal of a light emitting element of the second pixel and one terminal of an additional capacitor of the second pixel, applying an initialization potential to a gate of a drive transistor of the first pixel when a third switch of the first pixel is in an ON state, applying an initialization potential to a gate of a drive transistor of the second pixel when a third switch of the second pixel is in an ON state, and applying a reset potential to a first input/output terminal of the drive transistor of the first pixel when a fourth switch of the first pixel is in an ON state, switching a fourth switch of the first pixel to an OFF state, applying a power supply voltage to a second input/output terminal of the drive transistor of the first pixel by switching a fifth switch of the first pixel to an ON state, setting a potential between one input/output terminal and a gate of a drive transistor of the first pixel to a threshold voltage of a drive transistor of the first pixel, switching a third switch of the first pixel to an OFF state, applying a voltage according to a video signal to a gate of a drive transistor of the first pixel when a second switch of the first pixel is set to an ON state in a state where a light emitting element of the first pixel and a light emitting element of the second pixel are connected state, switching a second switch of the first pixel to an OFF state, blocking an electrical connection between a light emitting element of the first pixel and an additional capacitor of the first pixel, and a light emitting element of the second pixel and an additional capacitor of the second pixel by switching the first switch to an OFF state, and providing a current according to a gate voltage of a drive transistor of the first pixel to a light emitting element of the first pixel in a state where a power supply voltage is applied to the other input/output terminal of a drive transistor of the first pixel.

One embodiment of the present invention is a method for driving a display device, the display device comprising a first pixel and a second pixel adjoining the first pixel, the first pixel and the second pixel each include a drive transistor, a light emitting element, an additional capacitor, a second switch, a capacitor element, a fourth switch, a fifth switch, a sixth switch and a power supply line, a first input/output terminal of the drive transistor, a first terminal of the light emitting element and a first terminal of the additional capacitor are electrically connected, the second switch is connected with a gate of the drive transistor, a first terminal of the capacitor element is electrically connected with a gate of the drive transistor, a first terminal of the fourth switch is electrically connected with a second terminal of the fifth switch and a first terminal of the sixth switch, a second terminal of the sixth switch is electrically connected with a second input/output terminal of the drive transistor, a first terminal of the fifth switch is electrically connected with a power supply line, and a first switch electrically connecting a first terminal of a light emitting element included in the first pixel, a first terminal of an additional capacitor included in the first pixel, a first terminal of a light emitting element included in the second pixel, and a first terminal of an additional capacitor included in the second pixel, the method comprising turning on the first switch to electrically connect one terminal of a light emitting element of the first pixel and one terminal of an additional capacitor of the first pixel and one terminal of a light emitting element of the second pixel and one terminal of an additional capacitor of the second pixel, simultaneously applying an initialization potential to a gate of a drive transistor of the first pixel when a second switch of the first pixel is in an ON state, applying an initialization potential to a gate of a drive transistor of the second pixel when a second switch of the second pixel is in an ON state, and applying a reset potential to one input/output terminal of a drive transistor of the first pixel when a fifth switch of the first pixel is in an OFF state, and a fourth switch and a sixth switch of the first pixel are in an ON state, applying a power supply voltage to the second input/output terminal of the drive transistor of the first pixel by switching a fourth switch of the first pixel to an OFF state and switching a fifth switch of the first pixel to an ON state, setting a potential between one input/output terminal and a gate of a drive transistor of the first pixel to a threshold voltage of a drive transistor of the first pixel, simultaneously switching a second switch of the first pixel and a second switch of the second pixel to an OFF state, applying a voltage according to a video signal to a gate of a drive transistor of the first pixel when a second switch of the first pixel is set to an ON state in a state where a light emitting element of the first pixel and a light emitting element of the second pixel are connected state, switching a second switch of the first pixel to an OFF state, blocking an electrical connection between a light emitting element of the first pixel and an additional capacitor of the first pixel, and a light emitting element of the second pixel and an additional capacitor of the second pixel by switching the first switch to an OFF state, and providing a current according to a gate voltage of a drive transistor of the first pixel to a light emitting element of the first pixel in a state where a power supply voltage is applied to the other input/output terminal of a drive transistor of the first pixel.

One embodiment of the present invention is a method for driving a display device, the display device comprising a first pixel and a second pixel adjoining the first pixel, the first pixel and the second pixel each include a drive transistor, a light emitting element, an additional capacitor, a second switch, a capacitor element, a third switch, a fourth switch, a fifth switch, a sixth switch and a power supply line, a first input/output terminal of the drive transistor, a first terminal of the light emitting element and a first terminal of the additional capacitor are electrically connected, the second switch is connected with a gate of the drive transistor, a first terminal of the capacitor element is electrically connected with a gate of the drive transistor, a first terminal of the third switch is electrically connected with a gate of the drive transistor and a first terminal of the capacitor element, a first terminal of the fourth switch is electrically connected with a second terminal of the fifth switch and a first terminal of the sixth switch, a second terminal of the sixth switch is electrically connected with a second input/output terminal of the drive transistor, a first terminal of the fifth switch is electrically connected with a power supply line, and a first switch electrically connecting a first terminal of a light emitting element included in the first pixel, a first terminal of an additional capacitor included in the first pixel, a first terminal of a light emitting element included in the second pixel, and a first terminal of an additional capacitor included in the second pixel, the method comprising turning on the first switch to electrically connect one terminal of a light emitting element of the first pixel and one terminal of an additional capacitor of the first pixel and one terminal of a light emitting element of the second pixel and one terminal of an additional capacitor of the second pixel, applying an initialization potential to a gate of a drive transistor of the first pixel when a third switch of the first pixel is in an ON state, applying an initialization potential to a gate of a drive transistor of the second pixel when a third switch of the second pixel is in an ON state, applying a reset potential to the second input/output terminal of the drive transistor of the first pixel by switching a fifth switch of the first pixel to an ON state and switching a fourth switch and a sixth switch of the first pixel to an ON state, applying a power supply voltage to the second input/output terminal of the drive transistor of the first pixel by switching a fourth switch of the first pixel to an OFF state and switching a fifth switch of the first pixel to an ON state, setting a potential between one input/output terminal and a gate of a drive transistor of the first pixel to a threshold voltage of a drive transistor of the first pixel, switching a third switch of the first pixel to an OFF state, applying a voltage according to a video signal to a gate of a drive transistor of the first pixel when a second switch of the first pixel is set to an ON state in a state where a light emitting element of the first pixel and a light emitting element of the second pixel are connected state, switching a second switch of the first pixel to an OFF state, blocking an electrical connection between a light emitting element of the first pixel and an additional capacitor of the first pixel, and a light emitting element of the second pixel and an additional capacitor of the second pixel by switching the first switch to an OFF state, and providing a current according to a gate voltage of a drive transistor of the first pixel to a light emitting element of the first pixel in a state where a power supply voltage is applied to the other input/output terminal of a drive transistor of the first pixel.

DESCRIPTION OF EMBODIMENTS

Figure 1:
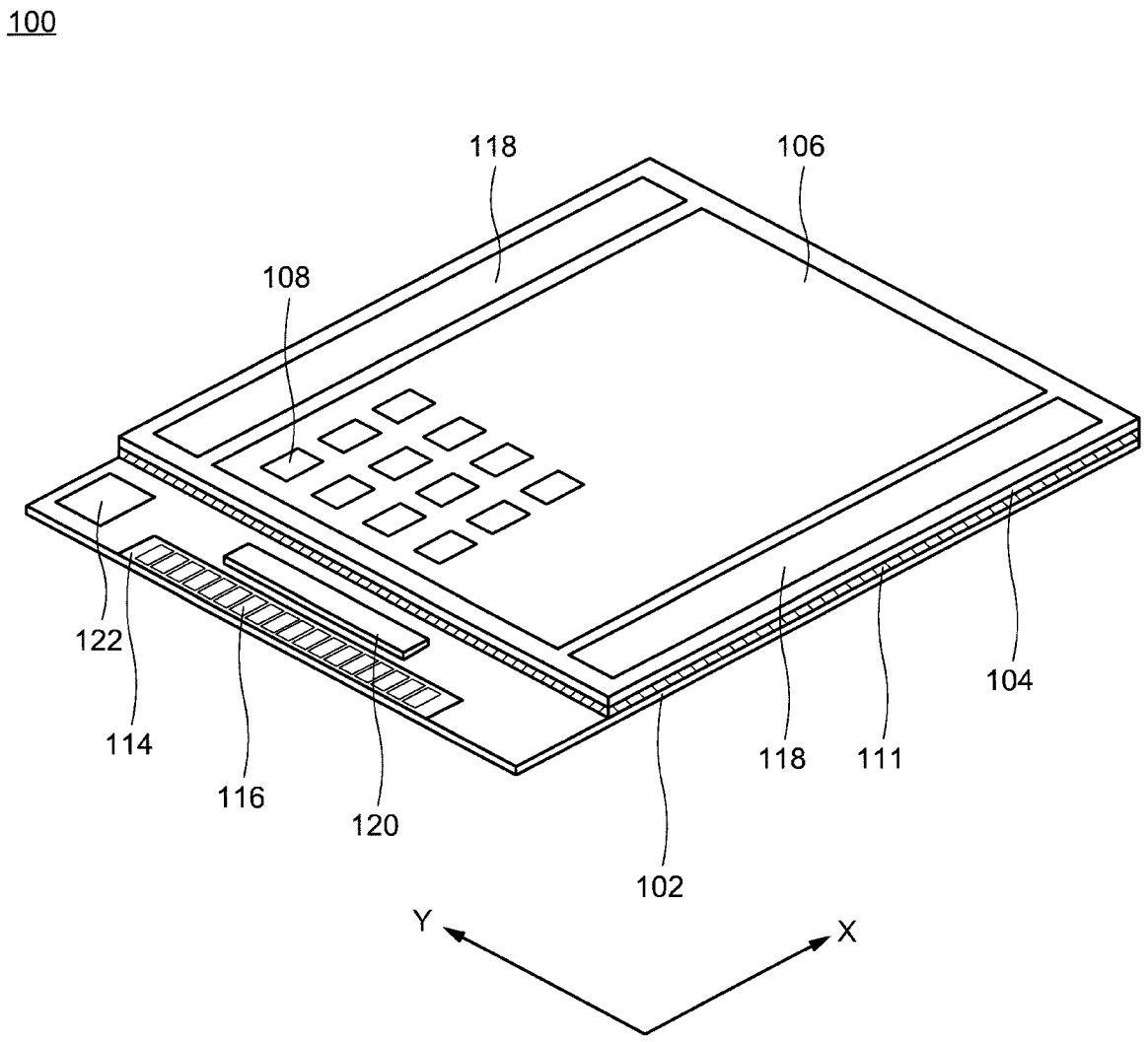
FIG. 1 is a schematic perspective diagram of a display device related to one embodiment of the present invention.

The embodiments of the present invention are explained below while referring to the drawings. However, the present invention can be implemented in many different modes and should not to be interpreted as being limited to the description of the embodiments exemplified below. In addition, although the drawings may be schematically represented in terms of width, thickness, shape, and the like of each part as compared with their actual mode in order to make explanation clearer, it is only an example and an interpretation of the present invention is not limited. Furthermore, in the present specification and each drawing, the same reference symbols (or reference symbols attached after numerals such as "a" and "b") are attached to the same elements as those described above with reference to preceding figures and a detailed explanation may be omitted accordingly. Furthermore, characters denoted by "first" and "second" with respect to each element are convenient symbols used for distinguishing each element and do not have any further meaning unless otherwise explained.

In the present specification, in the case where certain parts or regions are given as "above or on (under or below)" other parts or regions, as long as there is no particular limitation, this also includes the case where parts which are not only directly above (or directly below) other parts or regions but also in an upper direction (or lower direction), that is, the case where certain parts or regions are given as "above or on (under or below)" other parts or regions, other structural elements may be included between other parts or regions in an upper direction (or lower direction). Furthermore, in the explanation below, unless otherwise noted, a side on which a second substrate is arranged with respect to a first substrate in a cross-sectional view is referred to as "above (on)" or "upper" and the reverse is referred to as "under" or "below".

The first substrate explained in the present specification has at least one planar shaped main surface, and each layer such as an insulating layer, a semiconductor layer and a conductive layer, or each element such as a transistor and a display element are arranged on this one main surface. In the explanation below, in the case when the main surface of the first substrate is used as a reference and the first substrate is described as "above", "upper layer", "upwards" or "upper surface" in a cross-sectional view, unless stated otherwise, an explanation is provided while reference to one main surface of the first substrate.

The display device according to one embodiment of the present invention is explained. Generally, an EL display device includes a plurality of pixels arranged above a substrate. Each of the plurality of pixels is formed by a drive transistor, a light emitting element and an additional capacitor and the like included in the light emitting element. An additional capacitor included in a light emitting element also includes the case for example when a light emitting element having diode characteristics itself also has a capacitance component. In each pixel, driving of a drive transistor is controlled by a signal and thereby a light emitting current is supplied to the light emitting element. In addition, when the light emitting element emits light, it is possible for the display device to display an image. That is, the light emitting element becomes lighter and darker according to the size of the light emitting current. The size of the light emitting current is dependent on the amount of current which the drive transistor flows to the light emitting element. Specifically, a charge corresponding to the amount of current flowing through the drive transistor accumulates in the capacitor element described above and the additional capacitor. The size of the light emitting current is dependent on the amount of charge accumulated therein. If the amount of capacitance of the capacitor element and the additional capacitor becomes large, a voltage which is applied to the capacitor element and the additional capacitor is not increased and it is possible to increase the maximum value of a light emitting current which can be supplied to a light emitting element. In the display device according to one embodiment of the present invention, a larger capacitance value can be secured in one pixel than the capacitance value of included in that pixel. In other words, by securing a larger capacitance value than the capacitance value of a capacitor element or additional capacitor arranged in that pixel, it is possible to increase the maximum value of a light emitting current which can be supplied to a light emitting element. In addition, since it is possible to increase the maximum value of a light emitting current, it is possible to widen the dynamic range of a pixel in the display device according to one embodiment of the present invention. Specifically, in the plurality of pixels included in the display device, the light emitting element electrically connected to the driving transistor of a first pixel and the additional capacitor included in the light emitting element, and the light emitting element included in a second pixel adjacent to the first pixel and the additional capacitor included in the light emitting element are electrically connected by a capacitor control transistor of the first pixel before the light emitting element of the first pixel emits light. Next, the drive transistor is electrically connected to a power supply line and a video signal of the first pixel is supplied to the drive transistor of the first pixel, thereby a current flows through the drive transistor of the first pixel and a charge corresponding to the flown current value accumulates in each additional capacitor. In this way, the maximum value of the charge which can be accumulated based on the video signal of the first pixel can be increased as compared with a conventional case by the amount used for holding a charge also by the additional capacitor of an adjacent pixel. That is, a large light emitting current can be flown to the light emitting element arranged in the first pixel. Therefore, according to one embodiment of the present invention, it is possible to provide a display device which can secure a large emitting current when a pixel emits light. In addition, according to one embodiment of the present invention, it is possible to provide a display device which has pixels with a wide dynamic range.

First Embodiment

FIG. 1 is a schematic perspective diagram of a display device 100 according to one embodiment of the present invention.

The display device 100 includes a first substrate 102, a filler 111 and a second substrate 104. A first surface of the first substrate 102 includes a display area 106, a scanning signal line drive circuit 118, a video signal line drive circuit (driver IC) 120, a control circuit 122, and a terminal region 114 having a plurality of terminal electrodes 116. The display device 100 may also have a structure in which the second substrate 104 is not arranged. For example, the display device 100 may have a structure in which a protective film is bonded to a side on which the display region 106 of the first substrate 102 is located, or a structure in which a circularly polarizing plate is bonded on a side on which the display region 106 of the first substrate 102 is located.

The display region 106 has a plurality of pixels 108. The plurality of pixels 108 are arranged along one direction and a direction intersecting this one direction. The arrangement number of the pixels 108 is arbitrary. For example, n pixels are arranged the row direction and m pixels are arranged in the column direction. n and m are each a natural number of 2 or more.

For example, a device (omitted from the diagram) which outputs a timing signal and a wiring substrate (not shown in the diagram) are connected to the plurality of terminal electrodes 116. The timing signal is, for example, a signal which controls the operation of a video signal, the scanning signal line drive circuit 118, and the video signal line drive circuit 120. The wiring substrate is a substrate which connects a power supply with the display device 100. In addition, the wiring substrate is, for example, a flexible printed circuit (FPC). Parts of the plurality of terminal electrodes 116 which are in contact with a terminal of the wiring substrate are exposed to the exterior.

Each of the plurality of pixels 108 has a plurality of sub-pixels. For example, one pixel has three sub-pixels, and the three sub-pixels are comprised from a sub-pixel arranged with a display element corresponding to red (R), a sub-pixel arranged with a display element corresponding to green (G), and a sub-pixel arranged with a display element corresponding to blue (B). A color display device is provided by supplying multi-step voltages or currents of, for example, 256 levels to each of the three sub-pixels. In other words, for example, a color display device is provided by inputting a video signal of 256 levels. One sub-pixel may be simply called a pixel. In addition, for example, in the case of a structure in which one pixel includes one display element, a display device in which a black and white display or a grayscale display of white and black is provided. In addition, the arrangement of the plurality of pixels 108 is not limited. The arrangement of the plurality of pixels 108 is, for example, a stripe arrangement or a delta arrangement. Furthermore, in the display device 100 according to one embodiment of the present invention, an example in which a display element arranged in the pixel 108 is a light emitting element is explained.

Figure 2:
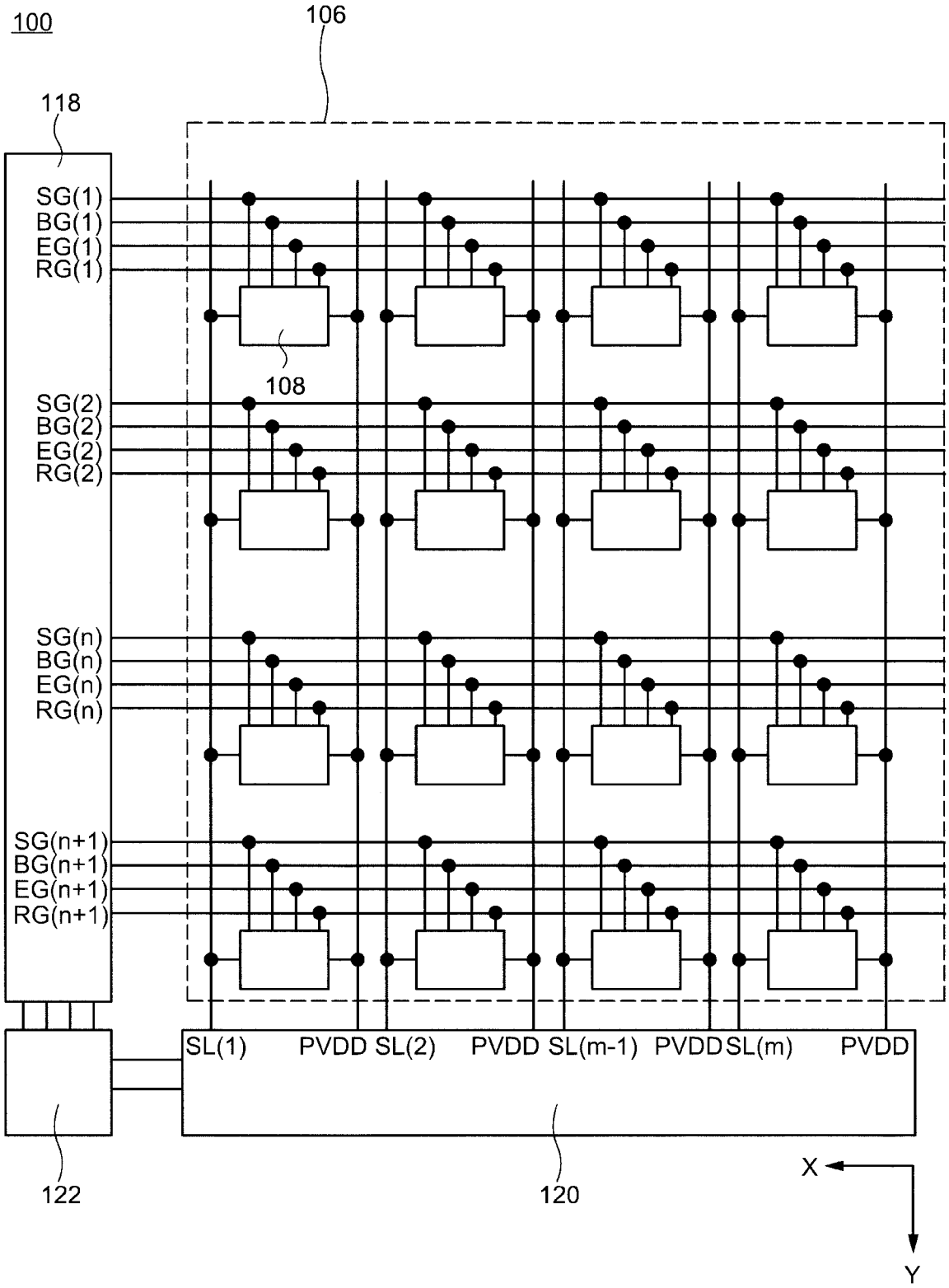
FIG. 2 is a schematic planar diagram of a display device related to one embodiment of the present invention.

FIG. 2 is a schematic planar diagram of a display device 100 according to one embodiment of the present invention. The display device 100 is an active matrix type EL display device. Each pixel 108 has a light emitting element. A video signal, a timing signal for controlling the operation of a circuit, and a power supply are supplied to the control circuit 122 via the plurality of terminal electrodes 116 shown in FIG. 1. The control circuit 122 supplies each signal and a power supply voltage to the scanning signal line drive circuit 118 and the video signal line drive circuit 120. The control circuit 122 generates a new signal or power supply voltage based on each signal or power supply voltage using a logic circuit (not shown in the diagram) or a voltage generation circuit (not shown in the diagram) included in the control circuit 122, and these may be supplied to the scanning signal line drive circuit 118 or the video signal line drive circuit 120. The position where the control circuit 122 is arranged is not limited to above the first substrate 102 shown in FIG. 1. For example, the control circuit 122 may be also be located above a wiring substrate which is connected to the terminal electrode 116.

The scanning signal line drive circuit 118 or the video signal line drive circuit 120 drives a light emitting element include in a pixel 108 using each signal or power supply voltage which is supplied from a control circuit. The scanning signal line drive circuit 118 or the video signal line drive circuit 120 has a role for displaying an image in the display region 106 by making the light emitting element emit light.

The scanning signal line drive circuit 118 supplies a scanning signal in common to the plurality of pixels 108 which are located on n rows formed within the display region 106 via the scanning signal line SG(n). The scanning signal line drive circuit 118 supplies a control signal in common to the plurality of pixels 108 which are located on n rows formed within the display region 106 via the control line RG(n). The scanning signal line drive circuit 118 supplies a light emitting control signal in common to the plurality of pixels 108 which are located on n rows formed with in the display region 106 via the light emitting control signal line BG(n). The scanning signal line drive circuit 118 supplies a capacitor control signal in common to the plurality of pixels 108 which are located on n rows formed within the display region 106 via the capacitor control signal line EG(n).

The video signal line drive circuit 120 supplies a video signal and an initialization signal in common to the plurality of pixels 108 located on m columns formed within the display region 106 via the video signal line SL(m). Herein, the potential of the video signal is denoted as Vsig(m), and the potential of the initialization signal is denoted as Vini. Vini may also be referred to as an initialization potential. The video signal is determined according to the image data which is displayed in the display region 106, and the potential Vsig(m) is adjusted by a correction method described herein. The potential Vini of the initialization signal as an be set as a fixed potential. The video signal line drive circuit 120 provides a bias signal to a plurality of pixels located on m columns via a bias line VL shown in FIG. 3. The potential of the bias signal is denoted as Vrst. Although the potential Vrst of the bias signal is a fixed potential in one embodiment of the present invention, the potential of the bias signal may also change over time.

The video signal line drive circuit 120 supplies a high potential and a low potential to each pixel 108 via a high potential power wiring PVDD. The high potential which is supplied from the high potential power supply wiring PVDD is referred to as VDD_H. The low potential which is supplied from the high potential power supply wiring PVDD is referred to as VDD_L. Although not shown in FIG. 2, in the display region 106, a common electrode is commonly arranged with respect to the plurality of pixels 108 and is connected to the low potential power wiring PVSS. The video signal line drive circuit 120 supplies the fixed potential VSS to the common electrode.

Figure 3:
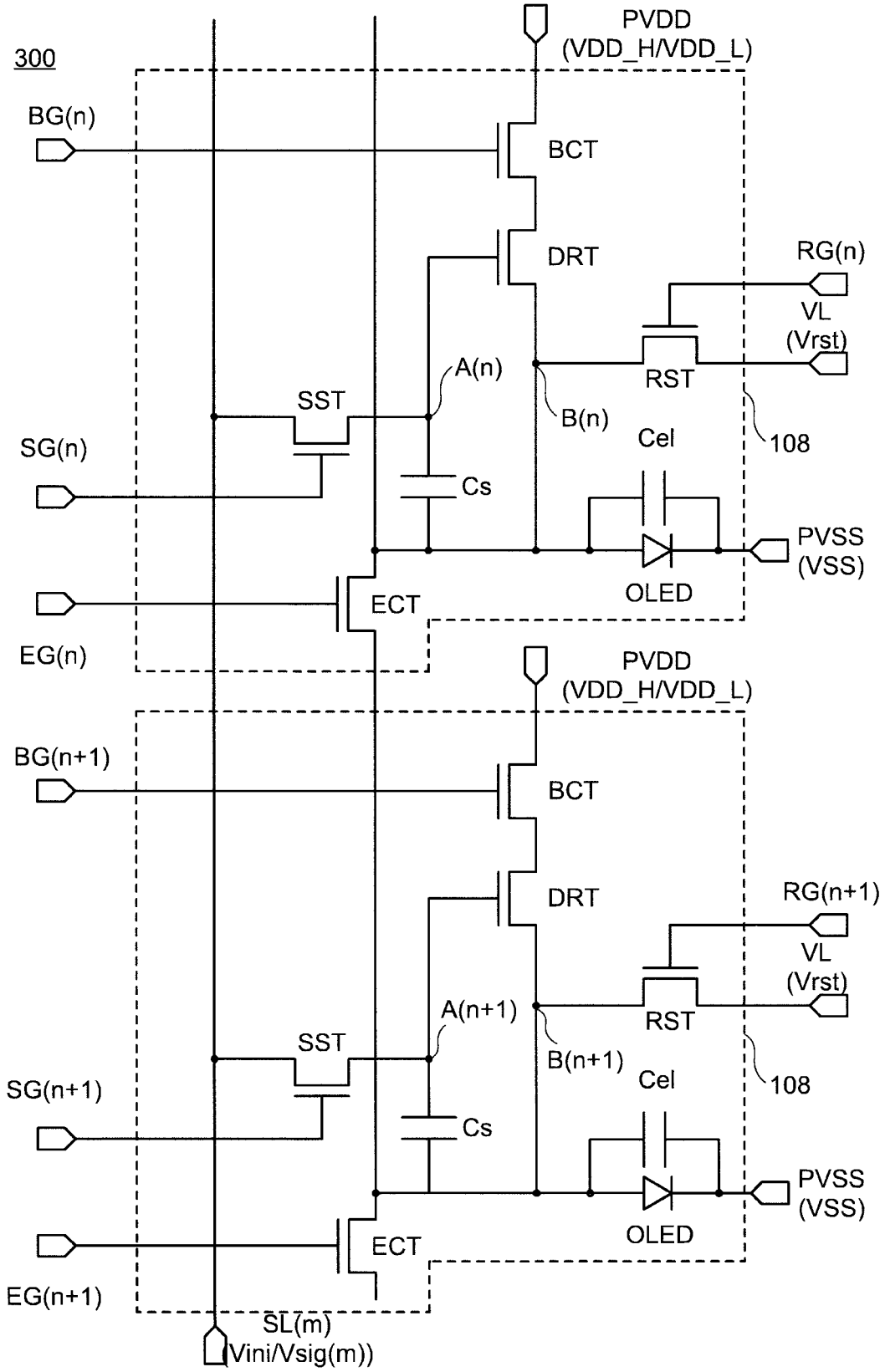
FIG. 3 is a circuit diagram of a pixel included in a display device related to one embodiment of the present invention.

FIG. 3 is a pixel circuit diagram 300 arranged in the pixel 108 according to one embodiment of the present invention. The pixel circuit diagram 300 shown in FIG. 3 shows two pixels 108 arranged on n rows and m columns and n+1 rows and m columns in the display region 106. Each of the two pixels 108 shown in FIG. 3 is arranged with one light emitting element OLED. In this way, the two pixels 108 shown in FIG. 3 may be two adjacent sub-pixels.

As is shown in FIG. 3, the pixel 108 includes a capacitor control transistor ECT (first switch), a selection transistor SST (second switch), a drive transistor DRT, a selection transistor SST (third switch), an initialization transistor RST (fourth switch), a light emitting control transistor BCT (fifth switch), a capacitor element Cs, a light emitting element OLED, and an additional capacitor Cel. Each of these transistors includes a gate and a pair of terminals (input/output terminal, source electrode and drain electrode) comprised from a first terminal and a second terminal. The capacitor element Cs includes a pair of terminals (first terminal, second terminal). The additional capacitor Cel includes a pair of terminals (first terminal, second terminal). The pair of terminals described above is also called a pair of electrodes. Furthermore, although an example in which the additional capacitor Cel is arranged in parallel with the light emitting element OLED is shown in FIG. 2, the present invention is not limited to the structure shown in FIG. 2. The additional capacitor Cel may be a parasitic capacitor of the light emitting element OLED, or may include a capacitor element arranged in parallel with the light emitting element OLED and a parasitic capacitor of the light emitting element OLED.

The drive transistor DRT has the role of making a current to flow to the light emitting element OLED based on an input video signal which makes the light emitting element OLED emit light. The selection transistor SST has the role of supplying a video signal and an initialization signal to the drive transistor DRT. The initialization transistor RST supplies a bias signal to the drive transistor DRT, the light emitting element OLED and the additional capacitor Cel, and has the role of initializing a circuit arranged in each pixel 108. The light emitting control transistor BCT controls a connection and non-connection between the drive transistor DRT and the high potential power supply wiring PVDD. That is, the light emitting control transistor BCT has the role of controlling light emission and non-light emission of the light emitting element OLED. The capacitor control transistor ECT electrically connects the light emitting element OLED and the additional capacitor Cel included in the pixel (for example, the pixel 108 located on n rows and m columns), and the light emitting element OLED and the additional capacitor Cel included in an adjacent pixels (for example, pixels 108 located on n+1 rows and m columns). In this way, the capacitor control transistor ECT has the role of increasing the capacitance value of the pixel and increasing the maximum value of the amount of current which can be supplied to the light emitting element of the pixel. The capacitor element Cs has the role of securing a potential corresponding to the threshold of the drive transistor DRT. In addition, the capacitor element Cs has the role of maintaining a potential which is input to the gate of the drive transistor DRT so that the pixel 108 can emit light. That is, the capacitor element Cs has the role of holding the input video signal or a gradation level of the input video signal. The light emitting element OLED includes diode characteristics. The light emitting element OLED includes a pixel electrode, the common electrode described above, and a light emitting layer (EL layer, organic layer) located between the pixel electrode and the common electrode. The additional capacitor Cel is a capacitor included in the light emitting element OLED. The input video signal may be held by the additional capacitor Cel and the capacitor element Cs.

In the selection transistor SST, the gate is electrically connected to the scanning signal line SG(n), the first terminal is electrically connected to the video signal line SL(m) and the second terminal electrically connected to the gate of the drive transistor DRT and the first terminal of the capacitor element Cs. In the drive transistor DRT, the first terminal is electrically connected to the second terminal of the light emitting control transistor BCT, and the second terminal is electrically connected to the input terminal (or pixel electrode) of the light emitting element OLED, the second terminal of the initialization transistor RST and the second terminal and the second terminal of the storage capacitor Cs. In the light emitting control transistor BCT, the gate is electrically connected to the light emitting control signal line BG(n) and the first terminal is electrically connected to the high potential power supply wiring PVDD. The first terminal of the additional capacitor Cel is electrically connected to the second terminal of the drive transistor DRT, and the second terminal of the additional capacitor Cel is electrically connected to the low potential power supply wiring PVSS. The output terminal (or the common electrode) of the light emitting element OLED is electrically connected to the low potential power supply wiring PVSS. The fixed potential VSS is applied to the low potential power supply wiring PVSS. The fixed potential VSS may be a fixed potential which is lower than a low potential VDD_L, and can be a ground potential for example. In the initialization transistor RST, the first terminal is electrically connected to the bias line VL and the gate is electrically connected to the control line RG(n). In the capacitor control transistor ECT, the gate is electrically connected to the capacitor control signal line EG(n) and the first terminal electrically connected to the second terminal of the capacitor element Cs, the input terminal of the light emitting element OLED, the first terminal of the additional capacitor Cel, the second terminal of the initialization transistor RST, and the second terminal of the drive transistor DRT. In addition, the second terminal of the capacitor control transistor ECT is electrically connected to the first terminal of the capacitor control transistor ECT on n+1 rows, the second terminal of the capacitor element Cs on the n+1 row, the input terminal of the light emitting element OLED on the n+1 row, the first terminal of the additional capacitor Cel on n+1 rows, the second terminal of the initialization transistor RST on n+1 rows, and the second terminal of the drive transistor DRT on n+1 rows. Furthermore, here a pixel on row n and column m is explained among the two pixels 108 which are shown in FIG. 3. The structure of pixels on n+1 rows and m columns is the same as the structure of a pixel on n row and m columns, and n is replaced with n+1.

Each transistor shown in FIG. 3 can include silicon or germanium in a channel region, or an oxide which shows semiconductor characteristics. For example, the oxide may include indium-gallium oxide (IGO) and indium-gallium-zinc oxide (IGZO). Although these transistors are all described as n-channel field effect transistors in the present embodiment, some or all of them may also be p-channel field effect transistors. The channel region of these transistors can include various morphologies selected from single crystal, polycrystal, microcrystalline or amorphous. For example, they may have a low temperature polysilicon (LTPS) which is obtained by melting and recrystallizing amorphous silicon at a relatively low temperature.

Figure 4:
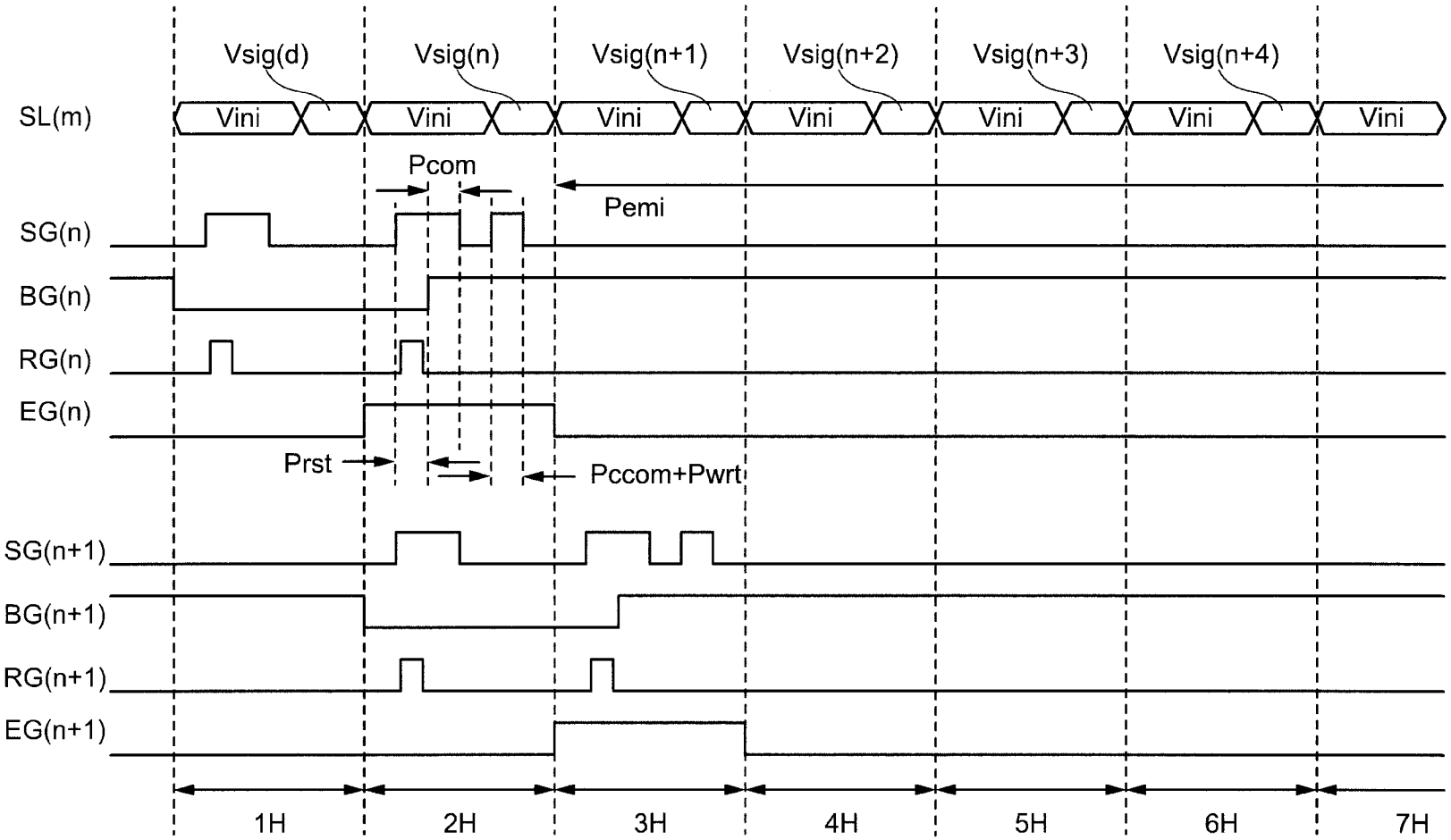
FIG. 4 is a timing chart of a pixel included in a display device related to one embodiment of the present invention.

FIG. 4 is a timing chart of a pixel included in the display device according to one embodiment of the present invention. In addition, FIG. 4 is a diagram showing a time change of each signal shown in FIG. 3. Herein, a method of driving a pixel of n rows and m columns is explained while referring to FIG. 4 and FIG. 3. Furthermore, although FIG. 4 also shows a timing chart of a pixel on n+1 rows and m columns, the basic operation is the same as a pixel on n rows and m columns. In addition, although the activation state of each transistor is explained below corresponding to the high level, it is optional for each signal whether to call a high level or a low level an activation state. Furthermore, in the present specification, activation state or activation refers to a state in which the source and the drain of a transistor are conducting, a state in which a current flows between the source and the drain, and a state in which the transistor is on. In addition, in the present specification, an inactivation state or inactivation refers to a state in which the source and drain of a transistor are not conducting, a state in which a current does not flow between the source and drain, and a state on which the transistor is off.

In the method of driving a display device according to one embodiment of the present invention, three operations are included in one horizontal time period (horizontal scanning period) with respect to a pixel on n rows and m columns. The three operations are, in order of execution, a reset operation, a threshold correction (threshold voltage variation correction) operation, a current correction (mobility variation correction) and a write operation. Light emission of the light emitting element OLED is carried out over a plurality of horizontal time periods following one horizontal time period including the three operations. Each time period corresponding to these operations are respectively referred to as a reset time period Prst, a threshold value correction time period Pcom, a current correction and write time period Pccom+Pwrt, and a light emitting time period Pemi. Furthermore, in FIG. 4, horizontal time periods are shown by 1H, 2H, 3H, 4H, 5H, 6H and 7H.

The reset operation is explained. Furthermore, for example, in one horizontal time period (1H in FIG. 4) before the horizontal time period (2H in FIG. 4) in which the reset operation is performed, an operation for supplying a high level from the scanning signal line SG(n) to the gate of the selection transistor SST on n rows and m columns, and writing of the potential Vini of an initialization signal to a node A(n) which is shown in FIG. 3, and an operation for supplying a high level from the control line RG(n) to the gate of the initialization transistor RST on n rows and m columns, and writing of the potential Vrst of a bias signal to a node B(n) which is shown in FIG. 3 may be performed. In addition, Vrst may be called a reset potential. Both of these two operations may be performed, or any one of these two operations may be performed. Vini at 1H and Vsig(d) at 1H may be the same potential.

In the reset time period Prst, first, a low level is supplied from the light emitting control signal line BG(n) to the gate of the light emitting control transistor BCT on n rows and m columns, a low level is supplied from the light emitting control signal line BG(n+1) to the gate of the light emitting control transistor BCT on n+1 rows and m columns, and both the light emitting control transistors BCT on n rows and m columns and n+1 rows and m columns are switched off. At this time, pixels on n rows and m columns and pixels on n+1 rows and m columns are in a dark state. Next, when a signal which is supplied from the scanning signal line SG(n) to the gate of the selection transistor SST on n rows and m columns changes from a low level to a high level, the selection transistors SST on n rows and m columns are switched on and Vini is written to the node A(n) shown in FIG. 3. In addition, when a signal which is supplied from the control line RG(n) to the gate of the initialization transistor RST on n rows and m columns changes from a low level to a high level, the initialization transistor RST on n rows and m columns is switched on and Vrst is written to the node B(n) shown in FIG. 3. In the reset time period Prst, a signal supplied from the capacitor control signal line EG(n) to the gate of the capacitor control transistor ECT on n rows and m columns is a high level, the capacitor control transistor ECT on n rows and m columns is switched on, the node B(n) and the node B(n+1) shown in FIG. 3 are conducting, and Vrst is written to the node B(n+1). When a signal supplied from the scanning signal line SG(n+1) to the gate of the selection transistor SST on the n+1 row and the m column changes from a low level to a high level, the selection transistor SST on the n+1 row and the m column is switched on and Vini is written to A(n+1) shown in FIG. 3. Furthermore, at this time, an initialization transistor RST on the n+1 row and m column may be on or off. That is, the signal of the control line RG(n+1) may be a high level or a low level. In addition, writing of Vini to the node A(n), writing of Vini to the node A(n+1), and writing of Vrst to the node B(n) may be carried out simultaneously.

In this way, in the reset time period Prst, the potentials of the node A(n) on n rows and m columns and the node A(n+1) on n+1 rows and m columns are set to Vini, and the potentials of the node B(n) on n rows and m columns and the node B(n+1) on n+1 rows and m columns are set to Vrst. That is, the potential between the first terminal and the second terminal of the capacitor element on n rows and m columns is set the same as the potential between the first terminal and the second terminal of each capacitor element on of the n+1 rows and m columns. That is, in the reset time period Prst, the potential between the gate and the second terminal of the drive transistor DRT on n rows and m columns and the potential between the gate and the second terminal of the drive transistor DRT on n+1 rows and m columns can be initialized.

Next, a threshold correction operation is explained. In the threshold correction time period Pcom, when a signal supplied from the control line RG(n) to the gate of the initialization transistor RST on n rows and m columns changes from a high level to a low level, the initialization transistor RST is switched off. Both the selection transistor SST on n rows and m columns and the selection transistor SST on n+1-rows and m columns are maintained in an on state, and the potential of the node A(n) and the potential of the node A(n+1) are maintained at Vini. The capacitor control transistor ECT on n rows and m columns is maintained in an on state, and the potential of the node B(n) and the potential of the node B(n+1) are maintained at Vrst. When a signal supplied from the light emitting control signal line BG(n) to the gate of the light emitting control transistor BCT on n rows and m columns changes from a low level to a high level, the light emitting control transistors BCT on n rows and m columns are switched on. When the light emitting control transistor BCT on n rows and m columns is switched on, VDD_H is supplied from the high potential power supply wiring PVDD to the drive transistor DRT of n rows and m columns via the light emitting control transistor BCT. In this way, a current flows to the drive transistor DRT on n rows and m columns, and the potential of the node B(n) shifts from Vrst to the high potential side. When a potential difference between the node A(n) and the node B(n) becomes equal to the threshold voltage Vthn of the drive transistor DRT on n rows and m columns, that is, when the potential of the node B(n) becomes Vini-Vthn, a current does not flow to the drive transistor DRT of n rows and m columns. At this time, the potential of the node B(n+1) becomes Vini−Vthn which is the same as the potential of the node B(n). In this way, the threshold voltage Vthn of the drive transistor DRT on n rows and m columns is held between the first terminal and the second terminal of the capacitor element Cs of n rows and m columns, and between the first terminal and the second terminal of the capacitor element Cs of n+1 rows and m columns.

In this way, in the threshold value correction time period Pcom, it is possible to hold the threshold voltage Vthn of the drive transistor DRT of n rows and m columns between the first terminal and the second terminal of the capacitor element Cs of n rows and m columns, and between the first terminal and the second terminal of the capacitor element Cs of n+1 rows and m columns. A write operation which is described later is carried out from the state where the threshold voltage Vthn is held in the capacitor element Cs. In this way, in the display device according to one embodiment of the present invention, even if the threshold voltage of each drive transistor DRT included in each of the plurality of pixels 108 varies, it is possible to remove variations in a threshold voltage when a light emitting element OLED included in each of the plurality of pixels 108 emits light.

Next, a current correction and write operation are explained. First, the operation between the threshold correction time period Pcom and the current correction and write time period Pccom+Pwrt are explained. When a signal which is supplied from the scanning signal line SG(n) to the gate of the selection transistor SST on n rows and m columns changes from a high level to a low level, the selection transistor SST on n rows and m columns is switched off. In addition, when a signal which is supplied to the gate of the selection transistor SST on n+1 rows and m columns from the scanning signal line SG(n+1) changes from a high level to a low level, the selection transistor SST on n+1 rows and m columns is also switched off. The capacitor control transistor ECT on n rows and m columns is maintained in an on state. At this time, the potential of the node B(n) and the potential of the node B(n+1) is maintained at Vini−Vthn. The light emitting control transistor BCT on n rows and m columns is maintained in an on state. The initialization transistor RST is maintained in an off state.

Next, a current correction and a write operation are explained. In the current correction and writing time period Pccom+Pwrt, the capacitor control transistor ECT on n rows and m columns is maintained in an on state. At the time when the current correction and write time period Pccom+Pwrt begins, the potential of the node B(n) and the potential of the node B(n+1) are maintained at Vini−Vthn. The light emitting control transistor BCT on n rows and m columns is maintained in an on state. The initialization transistor RST is maintained in an off state. Here, when the signal supplied from the scanning signal line SG(n) to the gate of the selection transistor SST on n rows and m columns changes from a low level to a high level, the selection transistor SST on n rows and m columns is switched on. Vsig(m) is supplied from the video signal line SL(m) which is electrically connected to the first terminal of the selection transistor SST, and the potential of the node A(n) changes from Vini to Vsig(m). That is, Vsig(m) is written to the node A(n). Here, since the gate voltage of the drive transistor DRT on n rows and m columns also becomes Vsig(m), the drive transistor DRT is switched on, and a current flows to the drive transistor DRT. An input terminal of the light emitting element OLED on n rows and m columns and n+1 rows and m columns, and a first terminal of the additional capacitor Cel on n rows and m columns and n+1 rows and m columns are electrically connected to the node B(n). Immediately after Vsig(m) is written to the node A(n), the potential of the node B(n) (the potential of the input terminal of the light emitting element OLED, and the anode voltage of the light emitting element OLED) is smaller than the threshold voltage of the light emitting element OLED and a current does not flows to the light emitting element OLED. Alternatively, the light emitting element OLED does not emit light. Here, a current flows to the additional capacitor Cel which charges the additional capacitor Cel. That is, as is shown in FIG. 3 and FIG. 4, the additional capacitor Cel on n rows and m columns and the additional capacitor Cel on n+1 rows and m columns are charged. Due to the charging of the additional capacitors Cel, the potential of the second terminal of the drive transistor DRT on n rows and m columns, that is, the potential of the node B(n) rises. As the mobility p of the drive transistor DRT becomes larger, the rise in the potential of the node B(n) also becomes larger. The raised potential of the node B(n) and the potential of B(n+1) are represented by the following formula (1) by capacitive coupling via the capacitor element Cs which is included in the pixel on n rows and m columns. In the following formulas, A(n) represents the potential of the node A(n), and B(n) represents the potential of the node B(n).

$$B(n) - B(n+1) - Vini - Vthn + (Vsig(m) - Vini) \times \frac{Cs}{(Cs + 2Cel)} \tag{1}$$

At this time, the potential difference between the gate and the second terminal of the drive transistor DRT of n rows and m columns (voltage between gate and source), that is, a potential difference between the node(A) and the node(B) is represented by the following formula (2).

$$A(n) - B(n) = Vthn + (Vsig(m) - Vini) \times \frac{2Cel}{(Cs + 2Cel)} \tag{2}$$

When the current correction and write time period Pccom+Pwrt ends, the capacitor element Cs on n rows and m columns holds the potential difference shown in the formula (2). In addition, the current Id which flows from the first terminal of the drive transistor DRT on n rows and m columns to the second terminal of the drive transistor DRT on n rows and m columns is expressed by the following formula (3). Here, β is a gain coefficient of a drive transistor DRT of n rows and m columns $$Id = \beta(A(n) - B(n) - Vthn)^2 \tag{3}$$

Substituting formula (2) for formula (3) and rearranging it to result in formula (4). Formula (4) shows that the current Id which flows from the first terminal of the drive transistor DRT on n rows and m columns to the second terminal of the drive transistor DRT does not depend on the threshold of the drive transistor DRT. In the display device according to one embodiment of the present invention, the more possible it is to reduce the potential difference between the node A(n) and the node B(n) by the amount of potential rise of the node B(n) which depends on the size of the mobility μ of the drive transistors DRT in advance before the light emitting time period Pemi described later. Therefore, even if there is variation in the mobility μ of each drive transistor DRT included in each of a plurality of pixels 108 in the display device according to one embodiment of the present invention, it is possible to remove the variation in the mobility μ when a light emitting element OLED included in each of the plurality of pixels 108 emits light.

$$Id = \beta\left\{(Vsig(m) - Vini) \times \frac{2Cel}{(Cs + 2Cel)}\right\}^2 \tag{4}$$

As is described above, in the current correction and writing time period Pccom+Pwrt, a video signal can be written and a current of the driving transistor DRT can be corrected.

In addition, the input terminals of the light emitting element OLED on n rows and m columns and n+1 rows and m columns are electrically connected with the first terminals of the additional capacitors Cel on n rows and m columns and n+1 rows and m columns by the capacity control transistor ECT. As a result, an additional capacitor Cel on n+1 rows and m columns is added to the additional capacitor Cel on n rows and m columns, and it is possible to hold a voltage or charge corresponding to the video signal which is input to the pixels 108 on n rows and m columns. In other words, when writing a video signal to a pixel 108 on n rows and m columns, it is possible to share an additional capacitor of an adjacent pixels (here, the additional capacitor Cel of a pixel 108 on n+1 rows and m columns). As a result, in the display device according to one embodiment of the present invention, it is possible to increase a potential difference between the node A(n) and the node B(n) (that is, a gate/source voltage of the drive transistor DRT) compared to the case where a capacitor control transistor ECT is arranged and an additional capacitor of an adjacent pixel is not shared. Therefore, the display device according to one embodiment of the present invention can realize a high dynamic range.

Furthermore, in the case where a video signal is written without carrying out a current correction operation in the current correction and writing time period Pccom+Pwrt, a signal which is supplied from the light emitting control signal line BG(n) to the gate of the light emitting control transistor BCT on n rows and m columns is changed to a low level, and the light emitting control transistor BCT on n rows and m columns is switched off.

Lastly, the operation of the light emitting time period Pemi is explained. In the light emitting time period Pemi, the light emitting control transistor BCT on n rows and m columns is maintained in an on state. The initialization transistor RST is maintained in an off state. When a signal which is supplied from the capacitor control signal line EG(n) to the gate of the capacitor control transistor ECT on n rows and m columns changes from a high level to a low level, the capacitor control transistor ECT on n rows and m columns is switched off. Node B(n) and node B(n+1) are separated by switching off the capacitor control transistor ECT. When a signal which is supplied from the scanning signal line SG(n) to the gate of the selection transistor SST on n rows and m columns changes from a high level to a low level, the selection transistor SST on n rows and m columns is switched off. As a result, the drive transistor DRT on n rows and m columns supplies a current to the light emitting element OLED based on the voltage held by the capacitor element Cs. In this way, light emission of the light emitting element OLED on rows and m columns starts. The light emitting current at this time is expressed by the formula (4).

Since the capacitor value is only the additional capacitor Cel component on n rows and m columns in the case when there is no capacitor control transistor ECT, the light emitting current is small. In the display device according to one embodiment of the present invention, the first terminal of the additional capacitor Cel on n rows and m columns and the first terminal of the additional capacitor Cel on n+1 rows and m columns are electrically connected by the capacitor control transistor ECT. As a result, pixels 108 on n rows and m columns share the additional capacitor Cel on n+1 rows and m columns with pixels 108 on n+1 rows and m columns. In this way, when a video signal is input to a pixel 108 on n rows and m columns, the capacitance of the pixel 108 is larger than a conventional pixel by the amount of sharing the additional capacitor Cel in the pixels 108 on n+1 rows and m columns. In the case where there is no capacitor control transistor ECT as in the prior art, the fractional part of the formula (2) and formula (4) becomes Cel/Cs+Cel. On the other hand, in the display device according to one embodiment of the present invention, the fractional part becomes 2Cel/Cs+2Cel as is shown in formula (2) and formula (4). Therefore, the display device according to one embodiment of the present invention can increase the maximum value of the light emitting current which can flow to the light emitting element OLED compared with the prior art.

Furthermore, in the case where a video signal is written without carrying out a current correction operation in the current correction and writing time period Pccom+Pwrt, a signal which is supplied to the gate of the light emitting control transistor BCT on n rows and m columns from the light emitting control signal line BG(n) is changed from a low level to a high level after the current correction and writing time period Pccom+Pwrt is finished, and the light emitting control transistor BCT on n rows and m columns is switched on. Following this, the light emitting element of n rows and m columns may start light emission according to driving method of the light emitting time period Pemi described above.

Figure 5:
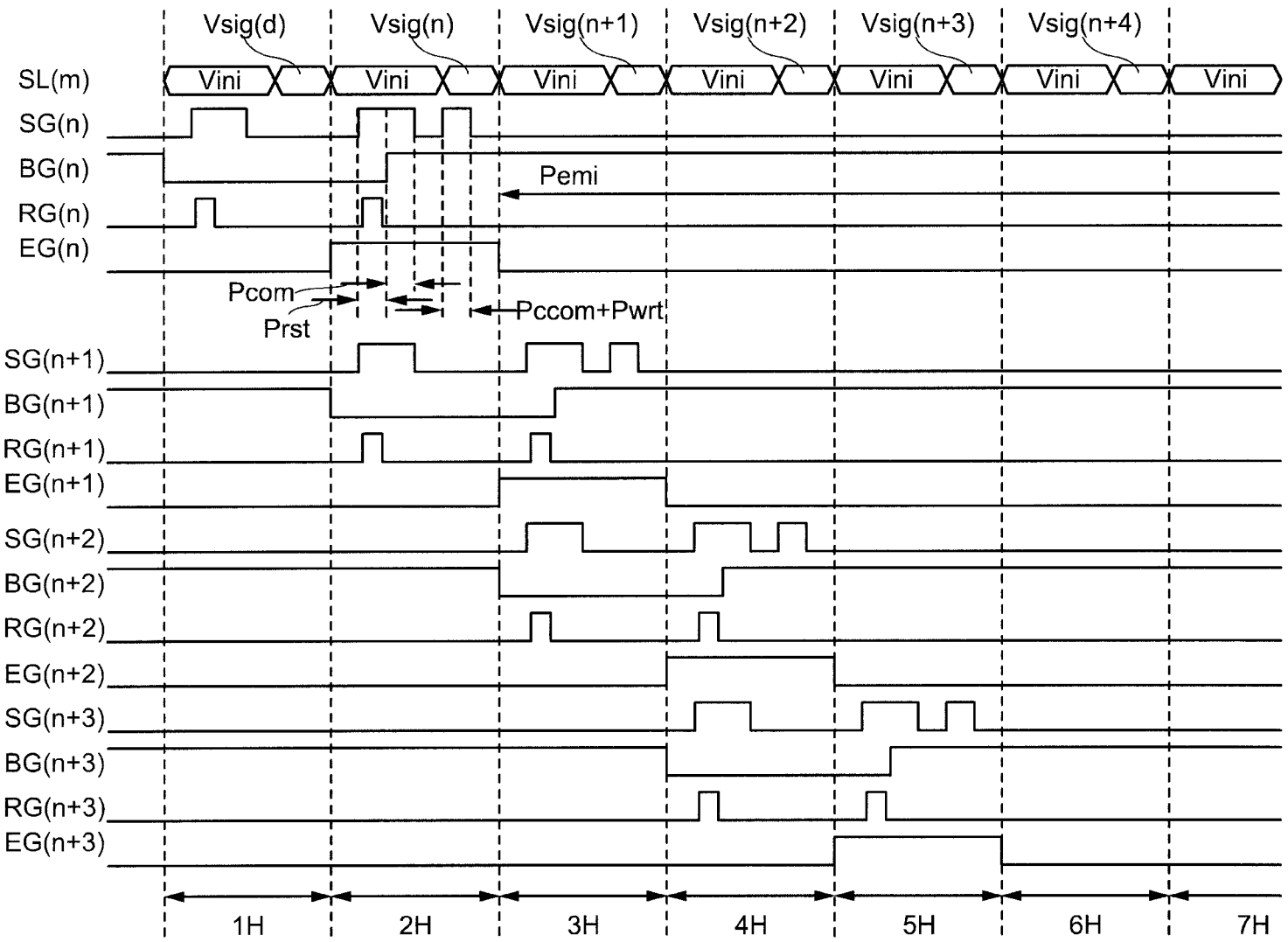
FIG. 5 is a timing chart of a pixel included in a display device related to one embodiment of the present invention.

FIG. 5 is a timing chart of a pixel included in a display device according to one embodiment of the present invention. FIG. 5 is a diagram in which timing charts of n+2 rows and m columns and n+3 rows and m columns are added to the timing chart in FIG. 4. Horizontal time periods are shown by 1H, 2H, 3H, 4H, 5H, 6H and 7H. The operation method of the reset time period Prst, the threshold value correction time period Pcom, the current correction and writing time period Pccom+Pwrt, and the light emitting time period Pemi explained using FIG. 4 and FIG. 3 are repeated in sequence from n rows and m columns shown in FIG. 5 to n+3 rows and m columns and subsequent rows. As a result, in the display device according to one embodiment of the present invention, it is possible to increase the current of the light emitting element of the display device and a high dynamic range can be realized.

Figure 6:
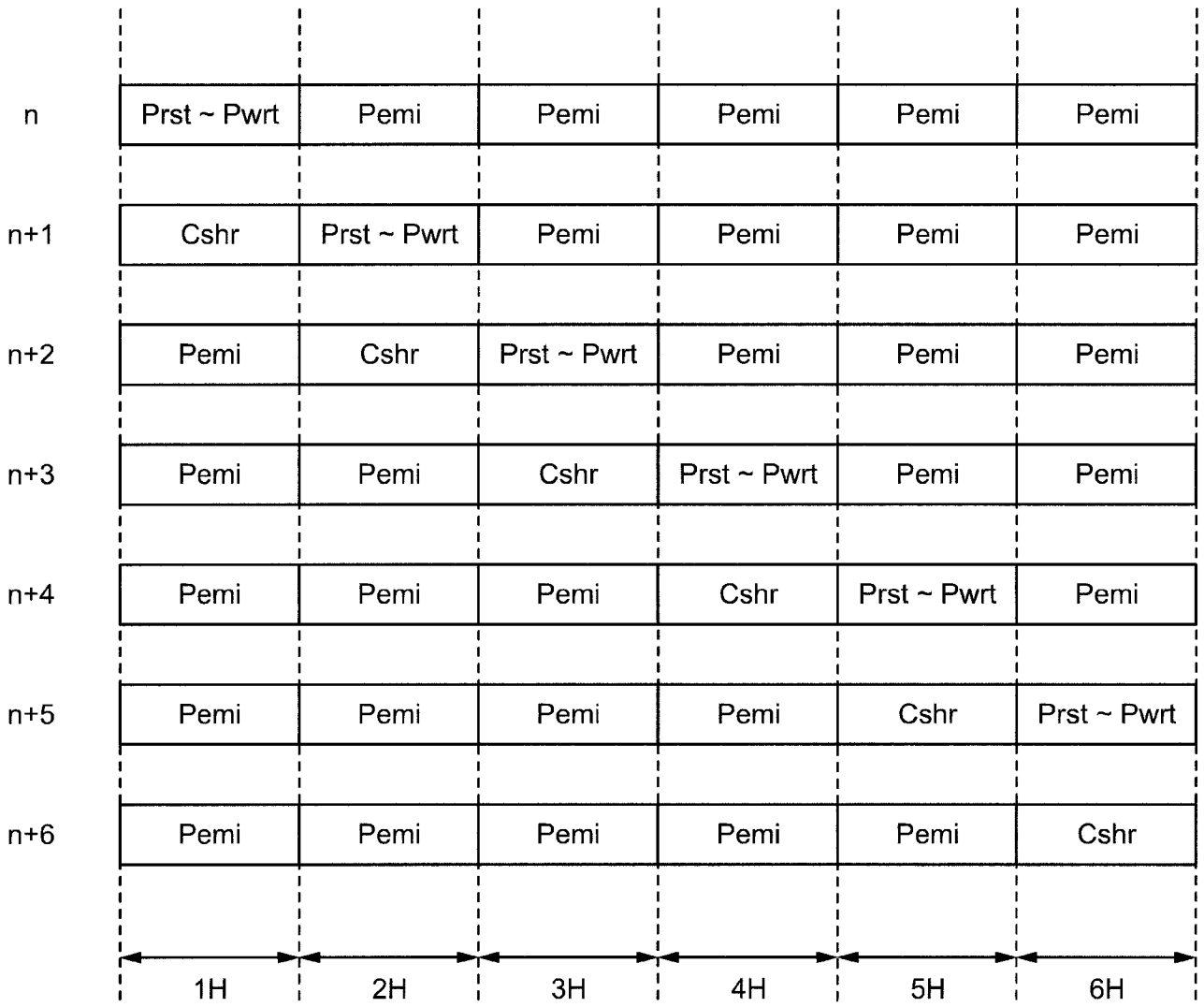
FIG. 6 is a schematic diagram showing the state of a pixel for each time period included in a display device related to one embodiment of the present invention.

FIG. 6 is a schematic diagram showing the state of a pixel included in the display device according to one embodiment of the present invention for each horizontal time period. FIG. 6 is a diagram showing an operation state in each horizontal time period of pixels of n rows and m columns to the pixels of n+3 rows and m columns and the following pixels of n+4 rows and m columns to n+6 rows and m columns shown in the timing chart of FIG. 5. A horizontal time period is shown by 1H, 2H, 3H, 4H, 5H and 6H. The time periods Prst to Pwrt in the diagram shown time periods in which the reset time period Prst, the threshold value correction time period Pcom, and the current correction and writing time period Pccom+Pwrt explained in FIG. 3 to FIG. 5 are performed. In the time period Cshr in the diagram shows a time period in a state where an additional capacitor Cel included in a pixel is electrically connected to the capacitor element Cs and the additional capacitor Cel included in that pixel in the previous row by the capacitor control transistor ECT in the previous row. In other words, it shows a state in which capacitors are shared between adjacent pixels. For example, the time period H2 is a state in which the additional capacitor Cel of the pixel on the n+2 row and m column is electrically connected to the capacitor element Cs and the additional capacitor Cel included in the pixel of n+1 rows and m columns. In this way, in the operation of one pixel included in the display device according to one embodiment of the present invention, by repeating the time period Cshr in which the additional capacitor Cel included in the pixel and the capacitor element Cs included in a pixel on a previous row are electrically connected to the additional capacitor Cel, the reset time period Prst, the threshold value correction time period Pcom, the current correction and writing time period Pccom+Pwrt and the light emitting time period Pemi, it is possible to increase the current of the light emitting element included in the display device according to one embodiment of the present invention and realize a high dynamic range. Furthermore, the horizontal time period before the time period Cshr may also be the light emission time period Pemi in the preceding frame time period.

As described above, in the display device according to one embodiment of the present invention, the input terminal of the light emitting element OLED on n rows and m columns and the first terminal of the additional capacitor Cel are electrically connected with the input terminal of the light emitting element OLED on n+1 rows and m columns and the first terminal of the additional capacitor Cel by the capacitor control transistor ECT. As a result, the display device according to one embodiment of the present invention can secure a large capacitance. In this way, the display device according to one embodiment of the present invention can increase the current of the light emitting element and a high dynamic range can be realized. When the pixel size is reduced together with high definition, a capacitor (capacitor element Cs, additional capacitor Cel) included in the pixel is also reduced in size. In this way, the voltage or potential difference held by the capacitor decreases, and the maximum value of the current which can flow to the light emitting element also decreases. In one embodiment of the present invention, since the capacitor element Cs and the additional capacitor Cel included in a pixel 108 on n rows and m columns and the additional capacitor Cel included in a pixel on n+1 rows and m columns are shared, it is possible to prevent the maximum value of the current which can flow to the light emitting element OLED from being reduced. That is, a sufficient amount of current can flow to the light emitting element OLED.

Therefore, by using one embodiment of the present invention, even in a display device which has a small pixel size, it is possible to supply a large current for a light emitting element to emit light and a decrease suppress a decrease in luminosity of the display device. In addition, by using one embodiment of the present invention, since it is possible to realize a high dynamic range when driving a pixel, the display device can perform high gradation display. Therefore, the display device and the driving method according to one embodiment of the present invention can provide a high definition display device with high display quality.

Second Embodiment

A pixel circuit according to the second embodiment is similar to the pixel circuit shown in the pixel circuit diagram 300 in FIG. 3. In the second embodiment, sharing an additional capacitor Cel arranged in a pixel 108 from n rows and m columns to n+3 rows and m columns and further securing a large light emitting current to realize a higher dynamic range by simultaneously switching on the capacitor control transistor ECT which is arranged on rows and m columns of a pixel 108 and the capacitor control transistor ECT which is arranged on n+1 rows and m columns of a pixel 108 is explained. Furthermore, an explanation of the same structure as in the first embodiment may be omitted.

Figure 7:
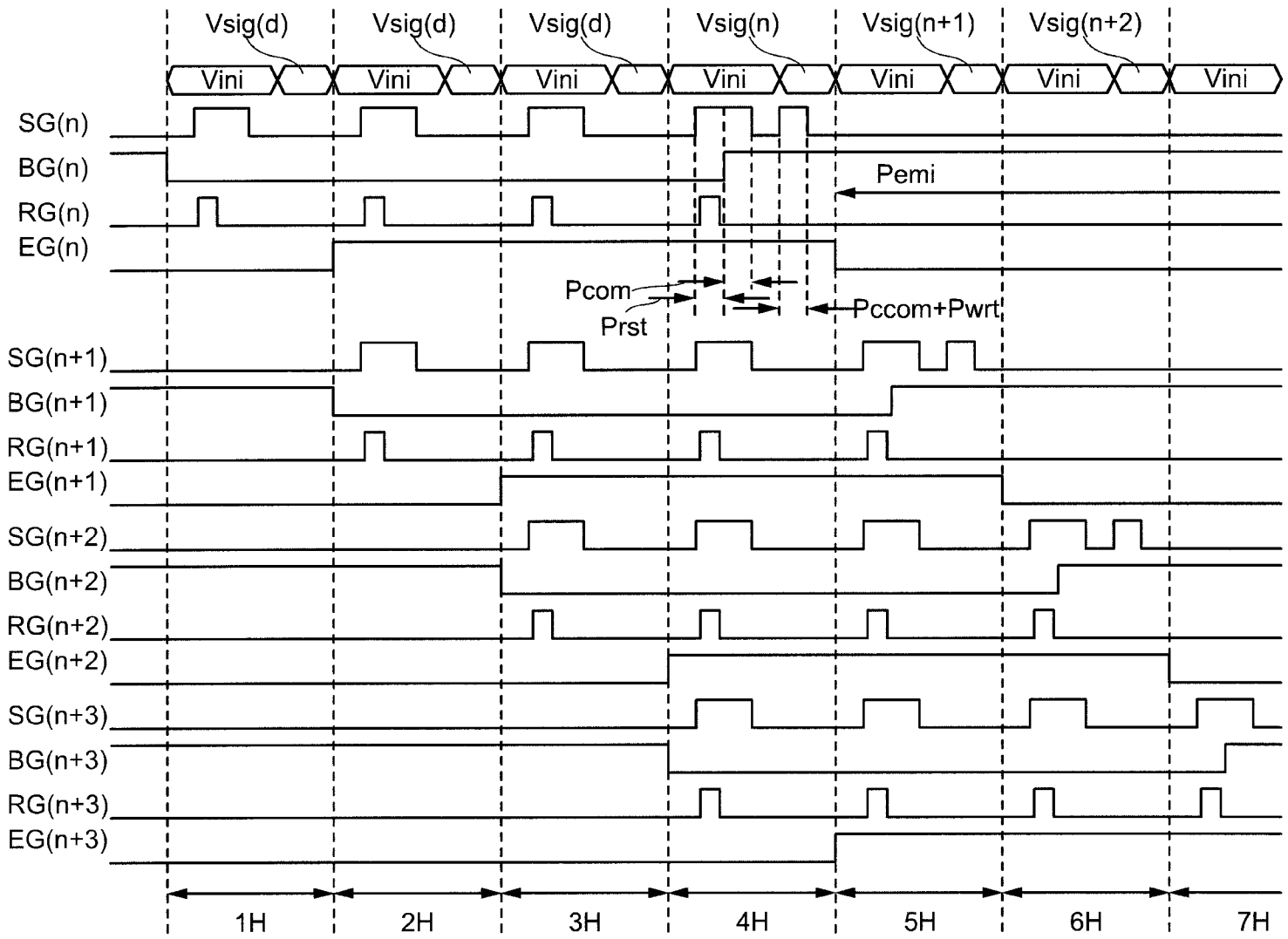
FIG. 7 is a timing chart of a pixel included in a display device related to one embodiment of the present invention.

FIG. 7 is a timing chart of the pixels 108 from n rows and m columns to n+3 rows and m columns included in the display device according to one embodiment of the present invention. Horizontal time periods are shown by 1H, 2H, 3H, 4H, 5H, 6H and 7H.

Here, the 4H current correction and write time period Pccom+Pwrt is explained. When a high level signal is supplied from the capacitor control signal line EG(n) to the gate of the capacitor control transistor ECT on n rows and m columns, the capacitor control transistor ECT on n rows and m columns is switched on. When a higher level signal is supplied from the capacitor control signal line EG(n+1) to the gate of the capacitor control transistor ECT on n+1 rows and m columns, the capacitor control transistor ECT on n+1 rows and m columns is switched on. When a high level signal is supplied from the capacitor control signal line EG(n+2) to the gate of the capacitor control transistor ECT on n+2 rows and m columns, the capacitor control transistor ECT on n+2 rows and m columns is switched on. When a high level signal is supplied from the capacitor control signal line EG(n+3) to the gate of the capacitor control transistor ECT on n+3 rows and m columns, the capacitor control transistor ECT on n+3 rows and m columns is switched on. Therefore, the second terminal of the capacitor element Cs on n rows and m columns, the first terminal of the additional capacitor Cel, the input terminal of the light emitting element OLED, the first terminal of the additional capacitor Cel on n+1 rows and m columns, and the first terminal of the additional capacitor Cel on n+3 rows and m columns are electrically connected. In this way, a potential difference (gate/source voltage) between the gate of the drive transistor DRT on n rows and m columns and the second terminal of the drive transistor DRT (gate/source voltage), that is, the potential difference between the node A(n) and the node B(n) is expressed in the following formula (5).

$$A(n) - B(n) = Vthn + (Vsig(m) - Vini) \times \frac{4Cel}{(Cs + 4Cel)} \tag{5}$$

In addition, the current Id which flows from the first terminal to the second terminal of the drive transistor DRT on n rows and m columns is expressed by the following formula (6). Here, β is a gain coefficient of the drive transistor DRT on n rows and m columns. The current Id which flows from the first terminal of the drive transistor DRT to the second terminal of the drive transistor DRT does not depend on the threshold of the drive transistor DRT.

$$Id = \beta\left\{(Vsig(m) - Vini) \times \frac{4Cel}{(Cs + 4Cel)}\right\}^2 \tag{6}$$

As is described above, in the current correction and writing time period Pccom+Pwrt in the display device according to one embodiment of the present invention, it is possible to perform writing of a video signal and correct the current of the driving transistor DRT.

In addition, in the current correction and writing time period Pccom+Pwrt in the display device according to one embodiment of the present invention, the input terminals of the light emitting element OLED from n rows and m columns to n+3 rows and m columns and the first terminal of the additional capacitor Cel from n rows and m columns to n+3 rows and m columns are electrically connected. In this way, when a video signal is written to a pixel 108 on n rows and m columns, the additional capacitor Cel arranged in three pixels 108 from n+1 rows and m columns to n+3 rows and m columns can be shared between three pixels from n+1 rows and m columns to n+3 rows and m columns. As a result, by using the driving method of the display device according to one embodiment of the present invention, as is shown in the formula (5), it is possible to further increase the gate/source voltage of the driving transistor DRT compared to the first embodiment and realize a higher dynamic range.

The operation of the 5H light emitting time period Pemi is explained. In the light emitting time period Pemi, the light emitting control transistor BCT on n rows and m columns is maintained in an on state. The initialization transistor RST is maintained in an off state. When a signal which is supplied from the capacitor control signal line EG(n) to the gate of the capacitor control transistor ECT on n rows and m columns changes from a high level to a low level, the capacitor control transistor ECT on n rows and m columns is switched off. Node B(n) and node B(n+1) to node B(n+3) are separated by switching off the capacitor control transistor ECT. When a signal which is supplied from the scanning signal line SG(n) to the gate of the selection transistor SST on n rows and m columns changes from a high level to a low level, the selection transistor SST on n rows and m columns is switched off. As a result, the drive transistor DRT on n rows and m columns supplies a current to the light emitting element OLED based on the voltage which is held by the capacitor element Cs. In this way, the light emitting elements on n rows and m columns start to emit light. The light emitting current at this time is expressed by the formula (6).

In the case when there is no capacitor control transistor ECT, a light emitting current is small since the capacitance value is only the additional capacitor Cel component on n rows and m columns. In the second embodiment, when a video signal is input to a pixel 108 on n rows and m columns, the capacitance used by the pixel 108 becomes larger by the component sharing the additional capacitor Cel arranged in the pixels 108 from n+1 rows and m columns to n+3 rows and m columns. Therefore, the maximum value of the light emitting current which flows to the light emitting element OLED can be increased.

Furthermore, in the case when a video signal is written without performing the current correction operation in the current correction and writing time period Pccom+Pwrt, the light emitting control transistor BCT on n rows and m columns may be switched on after the current correction and writing time period Pccom+Pwrt has ended the same as in the first embodiment, and light emitting elements on n rows and m columns may start emitting light.

Figure 8:
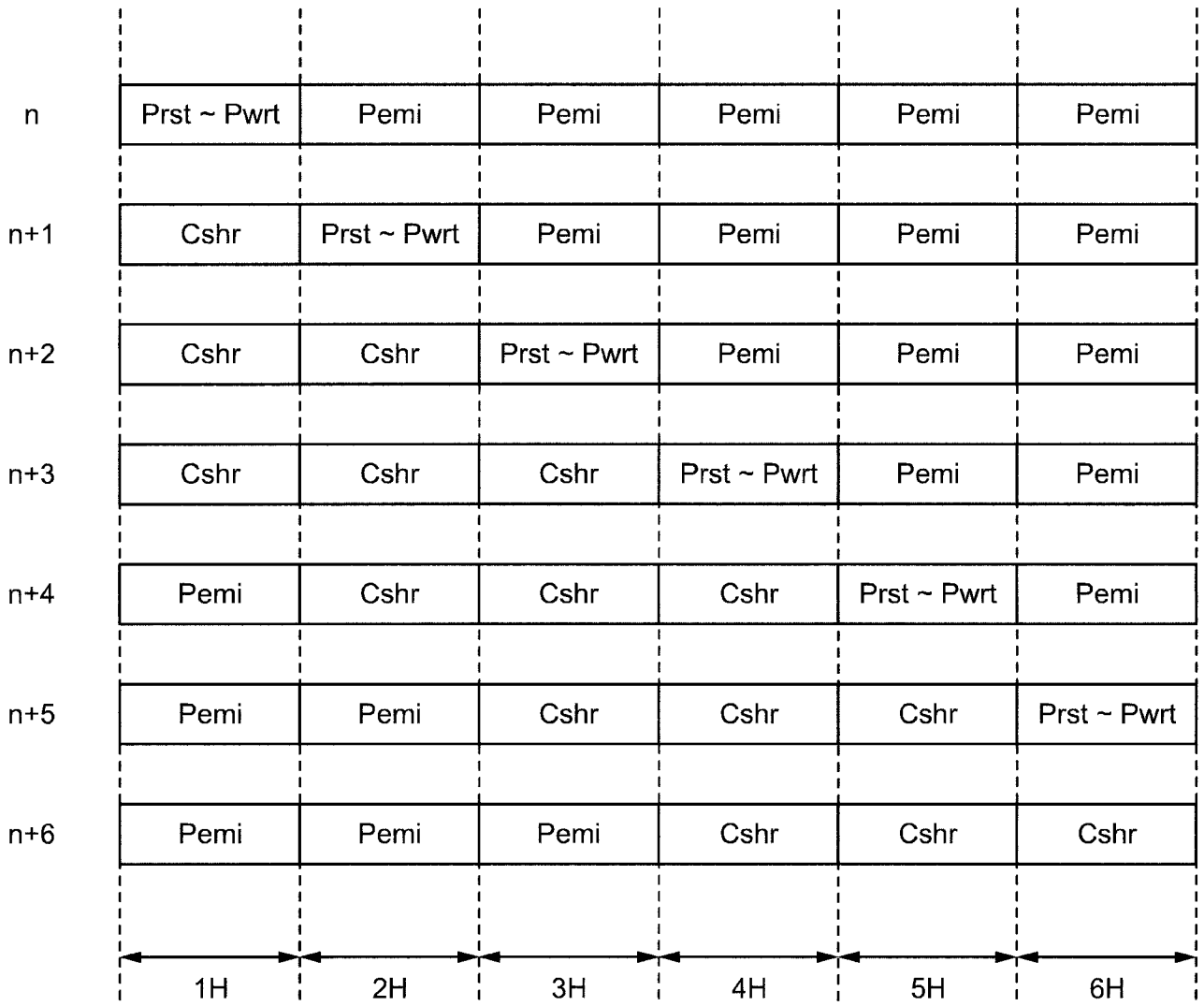
FIG. 8 is a schematic diagram showing the state of a pixel for each time period included in a display device related to one embodiment of the present invention.

FIG. 8 is a schematic diagram showing the state of pixels included in the display device according to one embodiment of the present invention for each horizontal time period. FIG. 8 shows the operation state of horizontal time periods of n rows and m columns, n+1 rows and m columns, n+2 rows and m columns, n+3 rows and m columns and also n+4 rows and m columns to n+6 rows and m columns shown in the timing chart in FIG. 7. Horizontal time periods are shown by 1H, 2H, 3H, 4H, 5H and 6H. Time periods Prst to Pwrt in the diagram show time periods in which the reset time period Prst, the threshold value correction time period Pcom, and the current correction and writing time period Pccom+Pwrt explained using FIG. 3 to FIG. 7 are carried out. A time period Cshr in the diagram shows a state in which the additional capacitor Cel is shared between adjacent pixels (for example, pixels 108 on n rows and m columns to n+3 rows and m columns) by the capacitor control transistor ECT. For example, a pixel on n+2 rows and m columns is in a state in which the reset operation, the threshold correction operation, the current correction and writing operation are performed in the time period H3. In the H3 time period, the capacitor element Cs and the additional capacitor Cel on n+2 rows and m columns, the additional capacitor Cel on n+3 rows and m columns, the additional capacitor Cel on n+4 rows and m columns, and the additional capacitor Cel on n+5 rows and m columns are shared. Therefore, the display device according to one embodiment of the present invention can further increase the current of a light emitting element OLED of a display device and can realize a higher dynamic range.

In the explanation above, although an example is shown in which an additional capacitor Cel arranged in each pixel are electrically connected by a capacitor control transistor ECT included in four pixels on n rows and m columns, n+1 rows and m columns, n+2 rows and m columns and n+3 rows and m columns, the additional capacitor Cel arranged in each pixel may also be electrically connected by the capacitor control transistor ECT arranged in three pixels on n rows and m columns, n+1 rows and m columns and n+2 rows and m columns. In this case, the potential difference between the node A(n) and the node B(n) of the drive transistor DRT is 4Cel which becomes 3Cel in the formulas (5) and (6) shown previously. In addition, in the pixels of k rows component, the additional capacitor Cel arranged in each pixel may be electrically connected. In this case, the potential difference between the node A(n) and the node B(n) of the drive transistor DRT is 4Cel which becomes kCel in the formulas (5) and (6) shown previously.

As described above, in the display device according to one embodiment of the present invention, an input terminal of a light emitting element OLED from n rows and m columns to n+3 rows and m columns and a first terminal of an additional capacitor Cel from n rows and m columns to n+3 rows and m columns are electrically connected. As a result, the display device according to one embodiment of the present invention can secure a larger capacitance. In this way, in the display device according to one embodiment of the present invention, the current of a light emitting element can be further increased and a higher dynamic range can be realized. Therefore, by using the display device according to one embodiment of the present invention, it is possible to supply a large current for the light emitting element to emit light and suppress a reduction in luminosity of the display device even in a display device which has a small pixel size. In addition, by using the display device according to one embodiment of the present invention, since a high dynamic range in can be realized when driving a pixel, it is possible to realize a display device with high gradation display. Therefore, the display device and driving method according to one embodiment of the present invention can provide a high definition display device with high display quality.

Third Embodiment

A pixel circuit according to one embodiment of the present invention further includes an initialization signal input transistor IST compared with the pixel circuit shown in the first embodiment. Furthermore, an explanation of the same structure as in the first embodiment and the second embodiment may be omitted.

Figure 9:
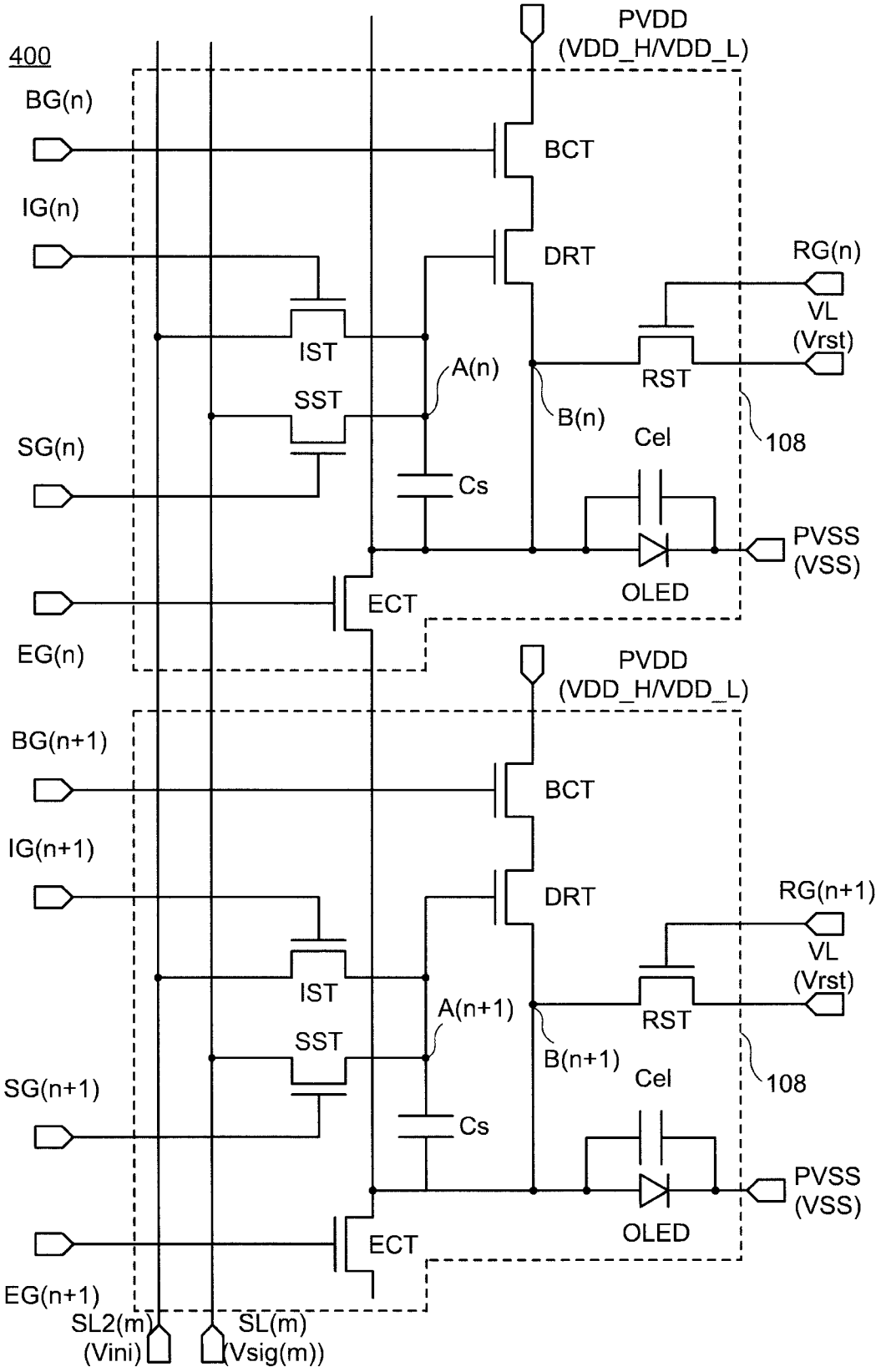
FIG. 9 is a circuit diagram of a pixel included in a display device related to one embodiment of the present invention.

FIG. 9 is a pixel circuit diagram 400 arranged in a pixel 108 included in the display device according to one embodiment of the present invention. The pixel circuit diagram 400 shows two pixels 108 on n rows and m columns and n+1 rows and m columns arranged within a display region 106.

As is shown in FIG. 9, in a pixel 108 has a structure in which an initialization signal input transistor IST is further included in the pixel circuit diagram 300 shown in FIG. 3. Similar to the explanation in FIG. 3, each transistor includes a gate and a pair of terminals (first and second terminals), a capacitor element Cs includes a pair of terminals (first and second terminals), and an additional capacitor Cel includes a pair of terminals (first and second terminals). Although an example in which the additional capacitor Cel is separately arranged is shown in FIG. 9, the present embodiment is not limited to this example. The additional capacitor Cel may be a parasitic capacitance or a capacitor including a parasitic capacitance.

The structure modified from FIG. 3 is explained using FIG. 9. In FIG. 9, since the structure other than the modification is the same as FIG. 3, an explanation here is omitted. In the initialization signal input transistor IST, a gate is electrically connected to an initialization signal control line IG(n), a first terminal is electrically connected to an initialization signal line SL2(*m*), and a second terminal is electrically connected to the gate of the drive transistor DRT, the second terminal of the selection transistor SST and the first terminal of the capacitor element Cs. In the pixel circuit diagram 300 shown in FIG. 3, although a potential Vini of the initialization signal is input from a video signal line SL(m) to a pixel 108 (selection transistor SST), in the pixel circuit diagram 400 shown in FIG. 9, Vini is input from the initialization signal line SL2(*m*) to the initialization signal input transistor IST. Here, among pixels on n rows and m columns among pixels 108 included in the pixel circuit are explained. The structure of pixels on n+1 rows and m columns is the same as pixels on n rows and m columns and n is replaced by n+1.

Figure 10:
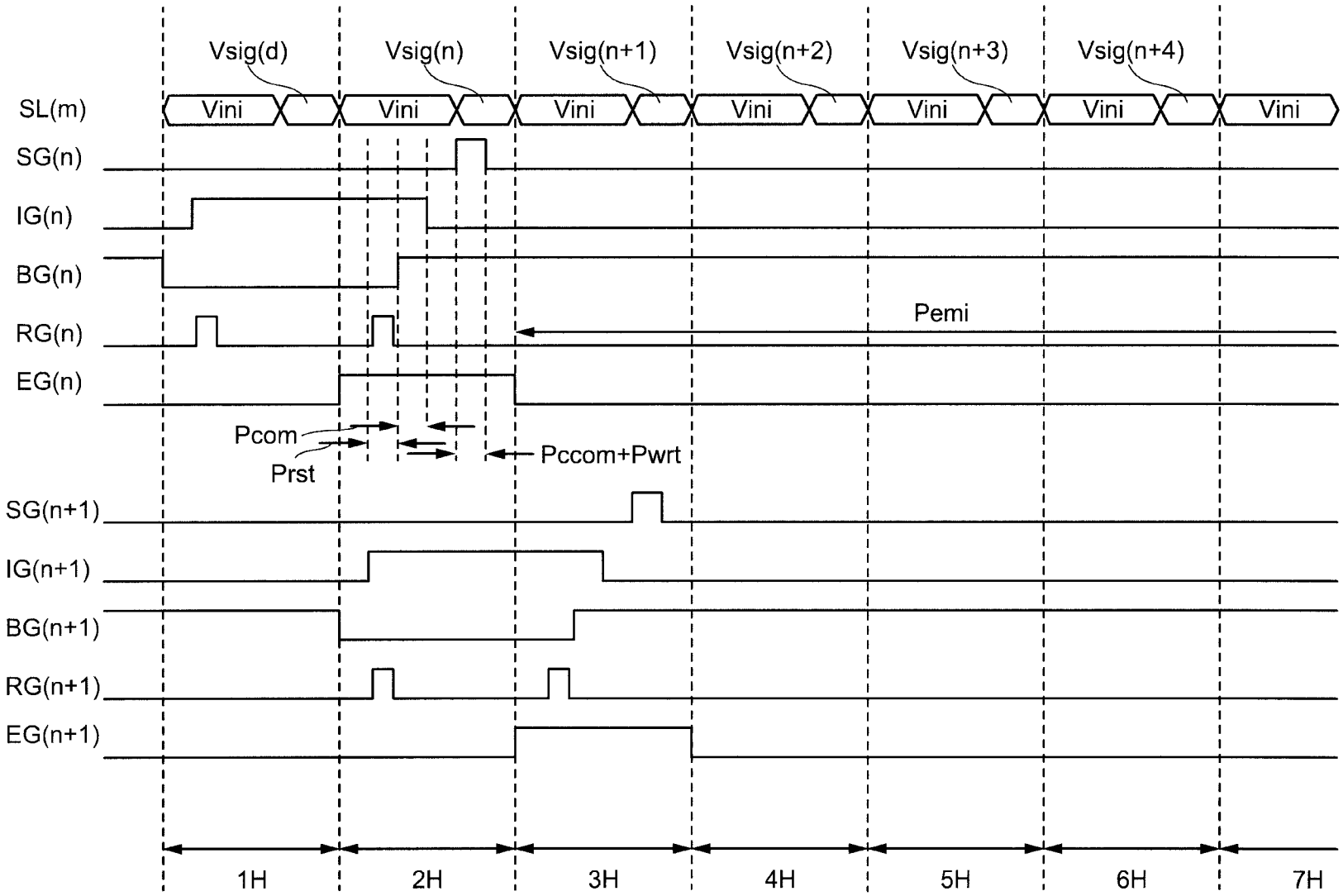
FIG. 10 is a timing chart of a pixel included in a display device related to one embodiment of the present invention.

FIG. 10 is a timing chart of pixels included in the display device according to one embodiment of the present invention and shows a time change of each signal shown in FIG. 9. A method of driving pixels on n rows and m columns is explained below using FIG. 10 and FIG. 9. Furthermore, although FIG. 10 also shows a timing chart of pixels on n+1 rows and m columns, the basic operation is the same as for pixels on n rows and m columns.

Also in the method of driving the display device according to one embodiment of the present invention, the reset operation is carried out in the reset time period Prst, the threshold correction operation is carried out in the threshold correction time period Pcom, the current correction and writing operation are carried in the current correction and writing time period Pccom+Pwrt, and light emission is carried out in the light emitting time period Pemi the same as in the first embodiment.

The reset operation is explained. Furthermore, for example, a high level is supplied from the initialization signal line IG(n) to the gate of the initialization signal input transistor IST on n rows and m columns which switches on the initialization signal input transistor IST, when Vini is written to the node(A) shown in FIG. 9, a high level is supplied from the control line RG(n) to the gate of the initialization transistor RST on n rows and m columns which switches on the initialization transistor RST, and Vrst may be written to the node(B) shown in FIG. 9. Both of these two operations may be carried out, or any one of these two operations may be carried out. Vini at 1H and Vsig(d) at 1H may be the same potential.

In the reset time period Prst, first, a low level is supplied from the light emitting control signal line BG(n) to the gate of the light emitting control transistor BCT on n rows and m columns, a low level is supplied from the light emitting control signal line BG(n+1) to the gate of the light emitting control transistor BCT on n+1 rows and m columns, and both transistors are switched off. At this time, pixels on n rows and m columns and pixels on n+1 rows and m columns are in a dark state. When a high level signal is supplied from the initialization signal control line IG(n) to the gate of the initialization signal input transistor IST on n rows and m columns, the initialization signal input transistor IST on n rows and m columns is switched on. In addition, when a high level signal is supplied from the initialization signal control line IG(n+1) to the gate of the initialization signal input transistor IST on n+1 rows and m columns, the initialization signal input transistor IST on n+1 rows and m columns is switched on. In this way, Vini is written to the nodes A(n) and A(n+1) shown in FIG. 9. A low level signal is supplied from the scanning signal line SG(n) to the gate of the selection transistor SST on n rows and m columns, and the selection transistor SST on n rows and m columns is switched off. A low level signal is supplied from the scanning signal line SG(n+1) to the gate of the selection transistor SST on n+1 rows and m columns, and the selection transistor SST on n+1 rows and m columns is inactivated and switched off. When the signal supplied from the control line RG(n) to the gate of the initialization transistor RST on n rows and m columns changes from a low level to a high level, the initialization transistor RST on n rows and m columns is switched on and Vrst is written to the node B(n) as is shown in FIG. 9. Here, when the signal supplied from the capacitor control signal line EG(n) to the gate of the capacitor control transistor ECT on n rows and m columns changes from a low level to a high level, the capacitor control transistor ECT on n rows and m columns is switched on and Vrst is written to the node B(n+1) shown in FIG. 9. Furthermore, at this time, the initialization transistor RST on n+1 rows and m columns may be on or off. In addition, writing Vini to the node A(n), writing Vini to the node A(n+1) and writing Vrst to the node B(n) may be carried out simultaneously.

In the pixel circuit diagram 300 shown in FIG. 3, the selection transistor SST is responsible for the operation of setting the potential of the node A(n) on n rows and m columns and the node A(n+1) on n+1 rows and m columns to Vini. In the pixel circuit diagram 400 shown in FIG. 9, the initialization signal input transistor IST is responsible for the operation. The selection transistor SST is responsible for carrying out an operation for writing a video signal to the gate of the drive transistor DRT, and the initialization signal input transistor IST is responsible for carrying out the operation described above. As a result, the display device according to one embodiment of the present invention can secure a sufficient time for the writing operation and the initialization signal input operation. In addition, the display device according to one embodiment of the present invention make driving a pixel stable.

Next, the threshold correction operation is explained. When the signal which is supplied from the control line RG(n) to the gate of the initialization transistor RST on n rows and m columns changes from a high level to a low level after the reset operation, the initialization transistor RST is switched off. The selection transistor SST on n rows and m columns and the selection transistor SST on n+1 rows and m columns are both maintained in an off state. The initialization signal input transistor IST on n rows and m columns and n+1 rows and m columns are both maintained in an on state. The potentials of the node A(n) and the node A(n+1) are maintained at Vini. The capacitor control transistor ECT on n rows and m columns is maintained in an on state, and the potentials of the node B(n) and the node B(n+1) are maintained at Vrst. When a high level signal is supplied from the light emitting control signal line BG(n) to the gate of the light emitting control transistor BCT on n rows and m columns, the light emitting control transistor BCT on n rows and m columns is switched on. When the light emitting control transistor BCT on n rows and m columns is switched on, VDD_H is supplied from the high potential power wiring PVDD to the drive transistors DRT on n rows and m columns via the light emitting control transistor BCT. As a result, a current flows through to the drive transistor DRT on n rows and m columns, and the potential of the node B(n) shifts from Vrst to the high potential side. When the potential difference between the node A(n) and the node B(n) becomes the same as the threshold voltage Vthn of the drive transistor DRT on n rows and m columns, that is, when the potential of node B(n) becomes Vini−Vthn, a current no longer flows to the drive transistor DRT on n rows and m columns. At this time, the potential of the node B(n+1) becomes Vini−Vthn which is the same as the potential of the node B(n). In this way, the threshold voltage Vthn of the drive transistor DRT on n rows and m columns is maintained between the first terminal and the second terminal of the capacitor element Cs on n rows and m columns, and between the first terminal and the second terminal of the capacitor element Cs on n+1 rows and m columns.

In the display device according to one embodiment of the present invention, it is possible to maintain a threshold voltage Vthn of the drive transistor DRT on n rows and m columns between the first terminal and the second terminal of the capacitor element Cs on n rows and m columns, and between the first terminal and second terminal of each capacitor element Cs on n+1 rows and m columns I in the threshold value correction time period Pcom. In this way, in the display device according to one embodiment of the present invention, it is possible to correct the threshold value of the drive transistor DRT the same as in the first embodiment.

Next, the current correction and write operation are explained. First, the operation between the threshold correction time period Pcom and the current correction and write time period Pccom+Pwrt is explained. The selection transistor SST on n rows and m columns and the selection transistor SST on n+1-rows and m columns are both maintained in an off state. The initialization signal input transistor IST on n+1 rows and m columns is maintained in an on state. When the signal which is supplied from the initialization signal control line IG(n) to the gate of the initialization signal input transistor IST on rows and m columns changes from a high level to a low level, the initialization signal input transistor IST on n rows and m columns is switched off. The light emitting control transistor BCT on n rows and m columns is maintained in an on state. The initialization transistor RST is maintained in an off state.

Next, the current correction and write operation are explained. In the current correction and write time period Pccom+Pwrt, the initialization signal input transistor IST on n+1 rows and m columns is maintained in an on state. The initialization signal input transistor IST on n rows and m columns is maintained in an off state. The remaining driving method is the same as in FIG. 4. Since the initialization signal input transistor IST on n+1 rows and m columns is maintained in an on state, in the time period Pwrt when a video signal is written to a pixel 108 on n rows and m columns, an initialization signal is input to the first terminal of the capacitor element Cs arranged in a pixel 108 on n+1 rows and m columns. In this way, when a video signal input to the pixel 108 on n rows and m columns is held, the pixel 108 on n rows and m columns and the pixel on n+1 rows and m columns can share not only the additional capacitor Cel of n+1 rows and m columns but also the capacitor element Cs on n+1 rows and m columns and the additional capacitor Cel and the capacitor element Cs on n rows and m columns. The potential of the node B(n) and the potential of the node B(n+1) are expressed in the formula (7) below. In addition, the potential difference (gate/source voltage) between the gate and the second terminal of the drive transistor DRT on n rows and m columns, that is, the potential difference between the node A(n) and the node B(n) is expressed in the formula (8) below. Furthermore, the current Id which flows from the first terminal to the second terminal of the drive transistor DRT on n rows and m columns is expressed in the formula (9) below and does not depend on the threshold of the drive transistor DRT. Therefore, in the display device according to one embodiment of the present invention, even if the mobility μ of the drive transistor DRT included in each of the plurality of pixels 108 varies as in the first embodiment, it is possible to remove variation in mobility μ when a light emitting element OLED included in each of the plurality of pixels 108 emits light.

$$B(n) = B(n+1) = Vini - Vthn + (Vsig(m) - Vini) \times \frac{Cs}{(Cs + 2Cel)} \tag{7}$$

$$A(n) - B(n) = Vthn + (Vsig(m) - Vini) \times \frac{2Cel}{(Cs + 2Cel)} \tag{8}$$

$$Id = \beta\left\{(Vsig(m) - Vini) \times \frac{2Cel}{(Cs + 2Cel)}\right\}^2 \tag{9}$$

In this way, it is possible to write a video signal and correct a current of the drive transistor DRT in the current correction and writing time period Pccom+Pwrt.

Furthermore, in the case of writing a video signal without performing a current correction operation in the current correction and writing time period Pccom+Pwrt, a signal which is supplied from the light emitting control signal line BG(n) to the gate of the light emitting control transistor BCT on n rows and m columns is switched to a low level and the light emitting control transistor BCT on n rows and m columns is switched turned off.

Lastly, the operation of the light emitting period Pemi is explained. In the light emitting period Pemi, the light emitting control transistor BCT of n rows and m columns is maintained in an on state. The initialization transistor RST is maintained in an off state. The initialization signal input transistor IST on n+1 rows and m columns is maintained in an on state. The initialization signal input transistor IST on n rows and m columns is maintained in an off state. When a signal which is supplied from the capacitor control signal line EG(n) to the gate of the capacitor control transistor ECT on n rows and m columns changes from a high level to a low level, the capacitor control transistor ECT on n rows and m columns is switched off. Node B(n) and node B(n+1) are separated by switching off the capacitor control transistor ECT. When a signal which is supplied from the scanning signal line SG(n) to the gate of the selection transistor SST on n rows and m columns changes from a high level to a low level, the selection transistor SST on n rows and m columns is switched off. As a result, the drive transistor DRT on n rows and m columns supplies a current to the light emitting element OLED based on the voltage held by the capacitor element Cs. In this way, light emission of the light emitting element OLED on n rows and m columns begins. The light emitting current at this time is expressed in the formula (4) shown previously.

As described above, in the display device according to one embodiment of the present invention as shown in the pixel circuit diagram 400 shown in FIG. 9, by arranging the initialization signal input transistor IST, the initialization signal input transistor IST is responsible for to initialization in a reset operation, and the selection transistor SST per-forms writing. As a result, in the display device according to one embodiment of the present invention, since the initialization signal input transistor IST and the selection transistor SST can be controlled independently of each other, it is possible to make a writing operation and an initialization operation clear. In this way, the display device according to one embodiment of the present invention can sufficiently secure time for a write operation and time for the initialization signal input operation, and can stabilize driving of a pixel. In addition, the display device according to one embodiment of the present invention can increase a current of a light emitting element by arranging the capacitor control transistor ECT and can also realize a high dynamic range. By using the display device according to one embodiment of the present invention, initialization of the display device is performed clearly, and thereby it is possible to carry out a threshold value correction and current correction of a drive transistor with high accuracy. Therefore, the display device and driving method according to one embodiment of the present invention can provide a high definition display device with high display quality.

Fourth Embodiment

A pixel circuit according to one embodiment of the present invention is a pixel circuit in which a position to which the initialization transistor RST is electrically connected changes compared with the circuit of the pixel shown in the first embodiment, and a current correction transistor CCT (sixth switch) is further included. Furthermore, an explanation of the same structure as in the first to third embodiments may be omitted.

Figure 11:
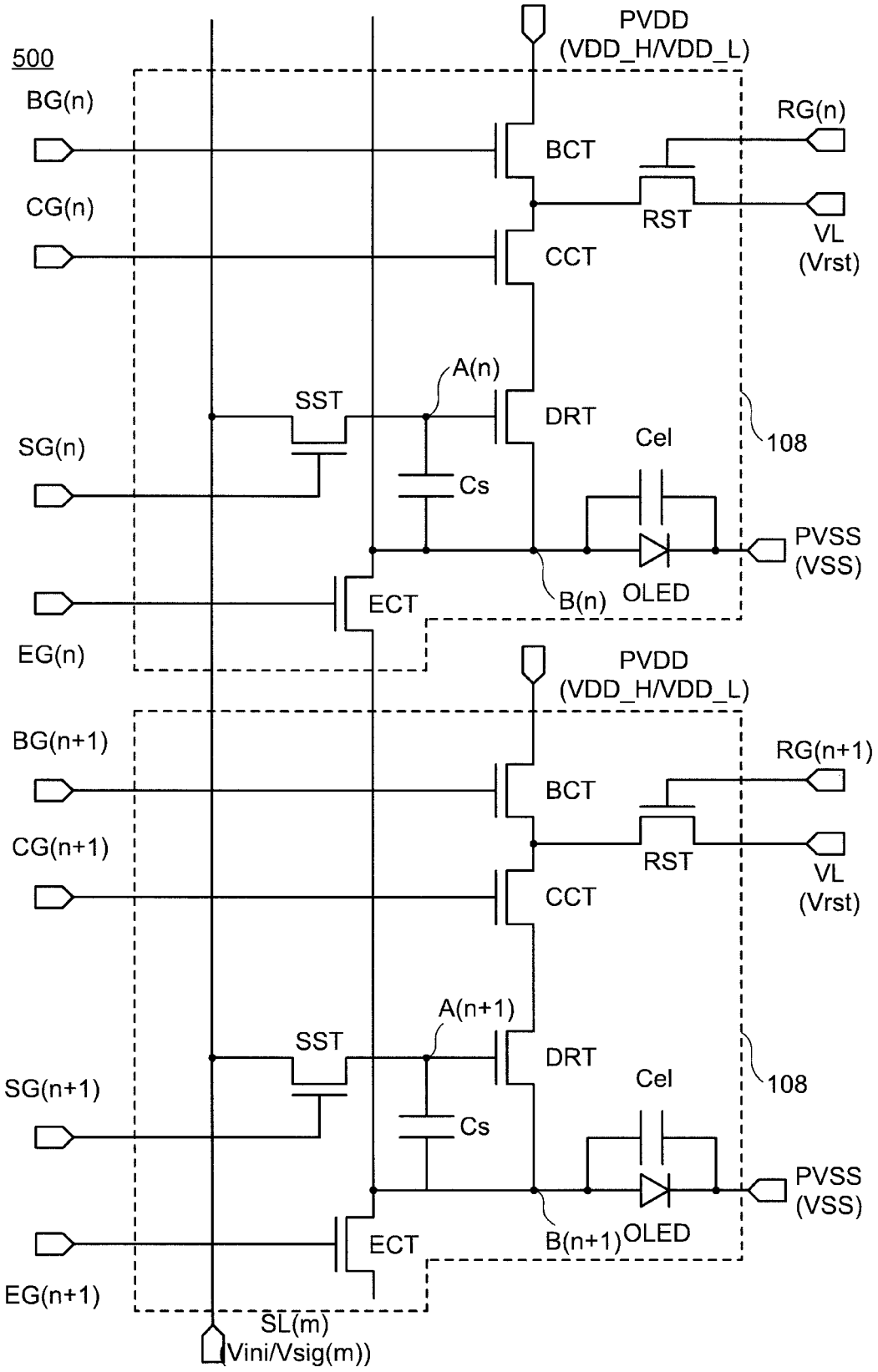
FIG. 11 is a circuit diagram of a pixel included in a display device related to one embodiment of the present invention.

FIG. 11 is a pixel circuit diagram 500 of a display device according to one embodiment of the present invention. The pixel circuit diagram 500 shows two pixels 108 of n rows and m columns and n+1 rows and m columns arranged within a display region 106.

As is shown in FIG. 11, a structure is shown in which the pixel circuit diagram 500 changes the position where the initialization transistor RST is electrically connected compared to the pixel circuit diagram 300 shown in FIG. 3 and further includes a current correction transistor CCT. Similar to the explanation in FIG. 3, each transistor includes a gate and a pair of terminals (first terminal, second terminal). The capacitor element Cs includes a pair of terminals (first terminal, second terminal). The additional capacitor Cel includes a pair of terminals (first terminal, second terminal). Furthermore, although an example in which the additional capacitor Cel is separately arranged is shown in FIG. 10, the present invention is not limited to this example. The additional capacitor Cel may be a parasitic capacitance or a capacitor including a parasitic capacitance.

As is shown in FIG. 11, in the selection transistor SST, the gate is electrically connected to the scanning signal line SG(n), the first terminal is electrically connected to the video signal line SL(m), and the second terminal is electrically connected to the gate of the drive transistor DRT and the first terminal of the capacitor element Cs. In the drive transistor DRT, the first terminal is electrically connected to the second terminal of the current correction transistor CCT, and the second terminal is electrically connected to the input terminal of the light emitting element OLED and the second terminal of capacitor element Cs. Connected. In the current correction transistor CCT, the gate is electrically connected to the current correction signal line CG(n), and the first terminal is electrically connected to the second terminal of the light emitting control transistor BCT and the second terminal of the initialization transistor RST. In the light emitting control transistor BCT, the gate is electrically connected to the light emitting control signal line BG(n), and the first terminal is electrically connected to the high potential power supply wiring PVDD. In the initialization transistor RST, the first terminal is electrically connected to the bias line VL, and the gate is electrically connected to the control line RG(n). A first terminal of the additional capacitor Cel is electrically connected to a second terminal of the drive transistor DRT, and a second terminal of the additional capacitor Cel is electrically connected to the low potential power supply wiring PVSS. The output terminal (or common electrode) of the light emitting element OLED is electrically connected to the low potential power wiring PVSS. The fixed potential VSS which is applied to the low potential power supply wiring PVSS may be a fixed potential lower than the low potential VDD_L, and can be set, for example, as a ground potential. In the capacitor control transistor ECT, the gate is electrically connected to the capacitor control signal line EG(n), and the first terminal is connected to the second terminal of the capacitor element Cs, the input terminal of the light emitting element OLED, the first terminal of the additional capacitor Cel, and the second terminal of the drive transistor DRT. In addition, the second terminal of the capacitor control transistor ECT is electrically connected to the first terminal of the capacitor control transistor ECT on n+1 rows, the second terminal of the capacitor element Cs on n+1 rows, the input terminal of the light emitting element OLED on n+1 rows, the first terminal of the additional capacitor Cel on n+1 rows, the second terminal of the initialization transistor RST on n+1 rows, and the second terminal of the drive transistor DRT on n+1 rows. Furthermore, here, a pixel on n rows and m columns among the two pixels 108 shown in FIG. 11 was explained. The structure of pixels on n+1 rows and m columns is the same as the structure of pixels on n rows and m columns with n being replaced with n+1.

Figure 12:
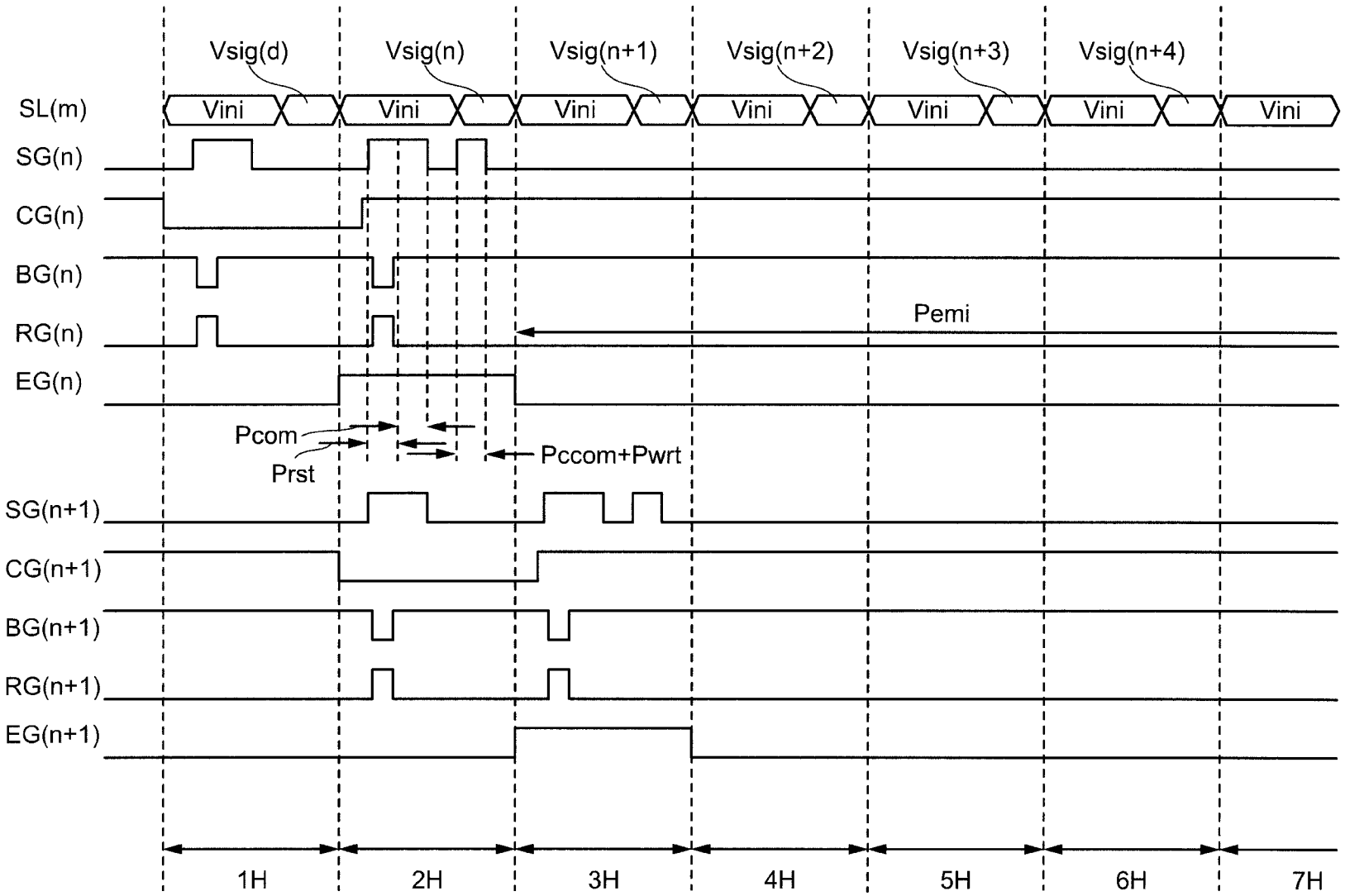
FIG. 12 is a timing chart of a pixel included in a display device related to one embodiment of the present invention.

FIG. 12 is a timing chart of pixels included in the display device according to one embodiment of the present invention, and is a timing chart showing a time change of each signal shown in FIG. 11. A method of driving a pixel on n rows and m columns is explained while referring to FIG. 12 and FIG. 11. Furthermore, although FIG. 12 also shows a timing chart of pixels on n+1 rows and m columns, the basic operation is the same as pixels on n rows and m columns.

Also in the method of driving the display device according to one embodiment of the present invention, the reset operation is carried out in the reset time period Prst, the threshold correction operation is carried in the threshold correction time period Pcom, the current correction and writing operation are carried out in the time period Pccom+Pwrt, and the light emission is carried out in the light emitting time period Pemi the same as in the first embodiment.

The reset operation is explained. Furthermore, for example, a high level may be supplied from the scanning signal line SG(n) to the gate of the selection transistor SST on n rows and m columns, and the operation for writing Vini in the node A(n) shown in FIG. 11 may carried out. A high level is supplied from the light emitting control signal line BG(n) to the gate of the light emitting control transistor BCT on n rows and m columns, a high level is supplied to the gate of the light emitting control transistor BCT on n+1 rows and m columns from the light emitting control signal line BG(n+1) and both transistors may be switched on. Both of two operations may be carried out or any one of two operations may be carried out. At this time, Vini in 1H and Vsig(d) in 1H may be the same potential.

In the reset time period Prst, first, when a signal which is supplied from the current correction signal line CG(n) to the gate of the current correction transistor CCT on n rows and m columns changes from a low level to a high level, the current correction transistors CCT on n rows and m columns is switched on. Next, a low level is supplied from the light emitting control signal line BG(n) to the gate of the light emitting control transistor BCT on n rows and m columns, and at the same time a low level is supplied to the gate of the light emitting control transistor BCT on n+1 rows and m columns from the light emitting control signal line BG(n+1) which switches both transistors off. At this time, pixels on n rows and m columns and pixels on n+1 rows and m columns are in a dark state. Next, when a signal which is supplied from the scanning signal line SG(n) to the gate of the selection transistor SST on n rows and m columns changes from a low level to a high level, the selection transistor SST on n rows and m columns are turned on and Vini is written to the node A(n) shown in FIG. 11. In addition, when a signal which is supplied from the control line RG(n) to the gate of the initialization transistor RST on n rows and m columns changes from a low level to a high level, the initialization transistor RST on n rows and m columns are switched on and Vrst is written to the node B(n) shown in FIG. 11 via the current correction transistor CCT. Here, when a signal which is supplied from the capacitor control signal line EG(n) to the gate of the capacitor control transistor ECT on n rows and m columns changes from a low level to a high level, the capacitor control transistor ECT on n rows and m columns is switched on. As a result, node B(n) and node B(n+1) shown in FIG. 11 are conducting and Vrst is written to the node B(n+1). When a signal which is supplied to the gate of the selection transistor SST from the scanning signal line SG(n+1) to the selection transistor SST on n+1 rows and m columns changes from a low level to a high level, the selection transistor SST on n+1 rows and m columns is switched on and Vini is written to A(n+1) shown in FIG. 11. Furthermore, at this time, the initialization transistor RST on n+1 rows and m columns may be on or off. In addition, writing Vini to the node A(n), writing Vini to the node A(n+1), and writing Vrst to the node B(n) may be carried out simultaneously.

In this way, in the reset time period Prst, the potentials of the node A(n) on n rows and m columns and the node A(n+1) on n+1 rows and m columns are set to Vini, and the potential of the node B(n) on n rows and m columns and the node B(n+1) on n+1 rows and m columns is set to Vrst. That is, the potential between the first terminal and the second terminal of the capacitor element on n rows and m columns is the same as the potential between the first terminal and the second terminal of each capacitor element on n+1 rows and m columns. Therefore, the potential between the gate and the second terminal of the drive transistor DRT on n rows and m columns and the potential between the gate and the second terminal of the drive transistor DRT on n+1 rows and m columns can be initialized.

Next, the threshold correction operation is explained. In the threshold correction time period Pcom, when a signal which is supplied from the control line RG(n) to the gate of the initialization transistor RST on n rows and m columns changes from a high level to a low level, the initialization transistor RST is switched off. Both the selection transistor SST on n rows and m columns and the select transistor SST on n+1 rows and m columns are maintained in an on state, and the potentials of the node A(n) and the node A(n+1) are maintained at Vini. The capacitor control transistor ECT on n rows and m columns is maintained in an on state, and the potentials of the node B(n) and the node B(n+1) are maintained at Vrst. The current correction transistor CCT on n rows and m columns is maintained in an on state. When a high level is supplied from the light emitting control signal line BG(n) to the gate of the light emitting control transistor BCT on n rows and m columns, the light emitting control transistor BCT on n rows and m columns is switched on. When the light emitting control transistor BCT on n rows and m columns is switched on, VDD_H is supplied from the high potential power supply wiring PVDD to the drive transistor DRT on n rows and m columns via the light emitting control transistor BCT. As a result, a current flows to the drive transistor DRT on n rows and m columns, and the potential of the node B(n) shifts from Vrst to the high potential side. When the potential difference between the node A(n) and the node B(n) becomes the same as the threshold voltage Vthn of the drive transistor DRT on n rows and m columns, that is, when the potential of the node B(n) becomes Vini−Vthn, a current no longer flows to the drive transistor DRT on n rows and m columns. The potential of the node B(n+1) is Vini−Vthn which is the same as the node B(n). In this way, the threshold voltage Vthn of the drive transistor DRT is held between the first and second terminals of the capacitor element on n rows and m columns and between the first and second terminals of each of the capacitor elements on n+1 rows and m columns.

In the display device according to one embodiment of the present invention, in the threshold value correction time period Pcom, it is possible to hold a threshold voltage Vthn of a drive transistor on n rows and m columns between the first terminal and the second terminal of the capacitor element Cs on n rows and m columns, and between the first terminal and second terminal of each capacitor element Cs on n+1 rows and m columns. In this way, the display device according to one embodiment of the present invention can correct the threshold value of the drive transistor DRT the same as in the first embodiment.

Next, a current correction and write operation are explained. First, the operation between the threshold correction time period Pcom and the current correction and write time period Pccom+Pwrt is explained. When a signal which is supplied from the scanning signal line SG(n) to the gate of the selection transistor SST on n rows and m columns changes from a high level to a low level, the selection transistor SST on n rows and m columns are switched off. In addition, when a signal which is supplied to the gate of the selection transistor SST on n+1 rows and m columns from the scanning signal line SG(n+1) changes from a high level to a low level, the selection transistor SST on n+1 rows and m columns is also switched off. The capacitor control transistor ECT of n rows and m columns is maintained in an on state. The potentials of the node B(n) and the node B(n+1) are maintained at Vini−Vthn. The light emitting control transistor BCT on n rows and m columns is maintained in an on state. The initialization transistor RST is maintained in an off state. The current correction transistor CCT on n rows and m columns is maintained in an on state.

Next, the current correction and write operation are explained. In the current correction and write time period Pccom+Pwrt, the current correction transistor CCT on n rows and m columns is maintained in an on state. The remainder of the driving method is the same as in FIG. 4. In addition, the same as FIG. 9, in the write time period Pwrt in which an image video signal is written to pixels 108 on n rows and m columns, an initialization signal is input to the first terminal of the capacitor element Cs arranged in the pixels 108 on n+1 rows and m columns. In this way, when holding a video signal which is input to the pixel 108 on n rows and m columns, it is possible to use both the capacitor element Cs of a pixel 108 on n rows and m columns and the capacitor element Cs on n+1 rows and m columns. The potentials of the node B(n) and the node B(n+1) are expressed in the formula (7) shown previously. In addition, the potential difference (gate/source voltage) between the gate and the second terminal of the drive transistor DRT on n rows and m columns, that is, the potential difference between the node A(n) and the node B(n) is expressed in the formula (8) shown previously. Furthermore, the current Id which flows from the first terminal to the second terminal of the drive transistor DRT on n rows and m columns is expressed in the formula (9) shown previously and does not depend on the threshold of the drive transistor DRT. In addition, in the display device according to one embodiment of the present invention, the same as in the first embodiment, even if the mobility μ of the drive transistor DRT which is included in each of a plurality of pixels 108 varies, it is possible to remove the variation in mobility μ when the light emitting element OLED arranged in each of the plurality of pixels 108 emits light.

As described above, in the current correction and writing time period Pccom+Pwrt, it is possible to write a video signal and correct the current of the driving transistor DRT.

Lastly, the operation of the light emitting time period Pemi is explained. In the light emitting time period Pemi, the current correction transistor CCT on n rows and m columns is maintained in an on state. The remainder of the driving method is the same as in FIG. 4. The node B(n) and the node B(n+1) are separated by switching off the capacitor control transistor ECT. Following this, light emission of the light emitting element OLED on n rows and m columns begins. The light emitting current at this time is expressed in the formula (4) shown previously.

In the pixel circuit diagram 500 shown in FIG. 11, the position where the initialization transistor RST is electrically connected is changed compared with the pixel circuit diagram 300 shown in FIG. 3 and a current correction transistor CCT is added. By adding the current correction transistor CCT in the display device according to one embodiment of the present invention, it is possible to select whether to supply a potential or current from PVDD which is supplied from the light emitting control transistor BCT to the drive transistor DRT. In the display device according to one embodiment of the present invention, it is possible to share the light emitting control transistor BCT between adjacent sub-pixels in a direction intersecting one direction. For example, in the case when one pixel is represented by three sub-pixels displaying R (red), G (green) and B (blue), each video signal is sent at the same timing. In this way, it is possible to share one light emitting control transistor BCT between three sub-pixels. That is, in the display device according to one embodiment of the present invention, it is possible to reduce the number of transistors per pixel by sharing one light emitting control transistor BCT among a plurality of sub-pixels, which makes it possible to reduce the pixel layout. In addition, in the display device according to one embodiment of the present invention, since it is possible to share a light emitting control transistor BCT, in the case when the area of the pixel layout is the same as the area of a conventional pixel layout, the degree of freedom of the pixel layout is improved. In this way, in the display device according to one embodiment of the present invention, since it is possible to increase storage capacity and additional capacity, it is possible to increase the maximum value of the light emitting current which can be supplied and it is possible to widen a dynamic range. Therefore, in the display device according to one embodiment of the present invention, by sharing the light emitting control transistor BCT, it is possible to provide a high definition and high luminosity display device with high gradation. Furthermore, although an example in which one light emitting control transistor BCT is provided in one pixel is shown in FIG. 11, as described above, one light emitting control transistor BCT may also be shared by a plurality of adjacent pixels on the same row. Furthermore, in the case where a video signal of a plurality of two or more pixels are simultaneously sent by time division, one light emitting control transistor BCT may be shared by a plurality of two or more pixels. For example, one light emitting control transistor BCT may be shared by six sub-pixels.

Furthermore, in the pixel circuit diagram 500 shown in FIG. 11, the second terminal of the initialization transistor RST is connected between the light emitting control transistor BCT and the current correction transistor CCT. In this way, the current correction transistor CCT can independently control to select whether to supply a potential or a current from the light emitting control transistor BCT to the drive transistor DRT and carry out threshold correction. Therefore, in the display device according to one embodiment of the present invention, it is possible to carry out light emission, threshold correction and current correction with high accuracy by including the current correction transistor CCT. In addition, in the display device according to one embodiment of the present invention, since it is possible for the initialization transistor RST to share by pixels adjacent in one direction, it is possible to reduce the number of transistors per pixel. In this way, in the display device according to one embodiment of the present invention, the pixel layout can be reduced. Furthermore, although an example in which one initialization transistor RST is arranged in one pixel is shown in FIG. 11, as described above, one initialization transistor RST may be arranged for one column.

Furthermore, in the display device according to one embodiment of the present invention, by arranging a capacitor control transistor ECT, it is possible to increase the maximum value of the light emitting current which can be supplied and realize a high dynamic range. Therefore, the display device and driving method according to one embodiment of the present invention can provide a high definition display device with high display quality.

Fifth Embodiment

The pixel circuit according to one embodiment of the present invention includes an initialization signal input transistor IST compared with the pixel circuit diagram 500 of the fourth embodiment shown in FIG. 11. The explanation of the same structure as in the first to fourth embodiments may be omitted.

Figure 13:
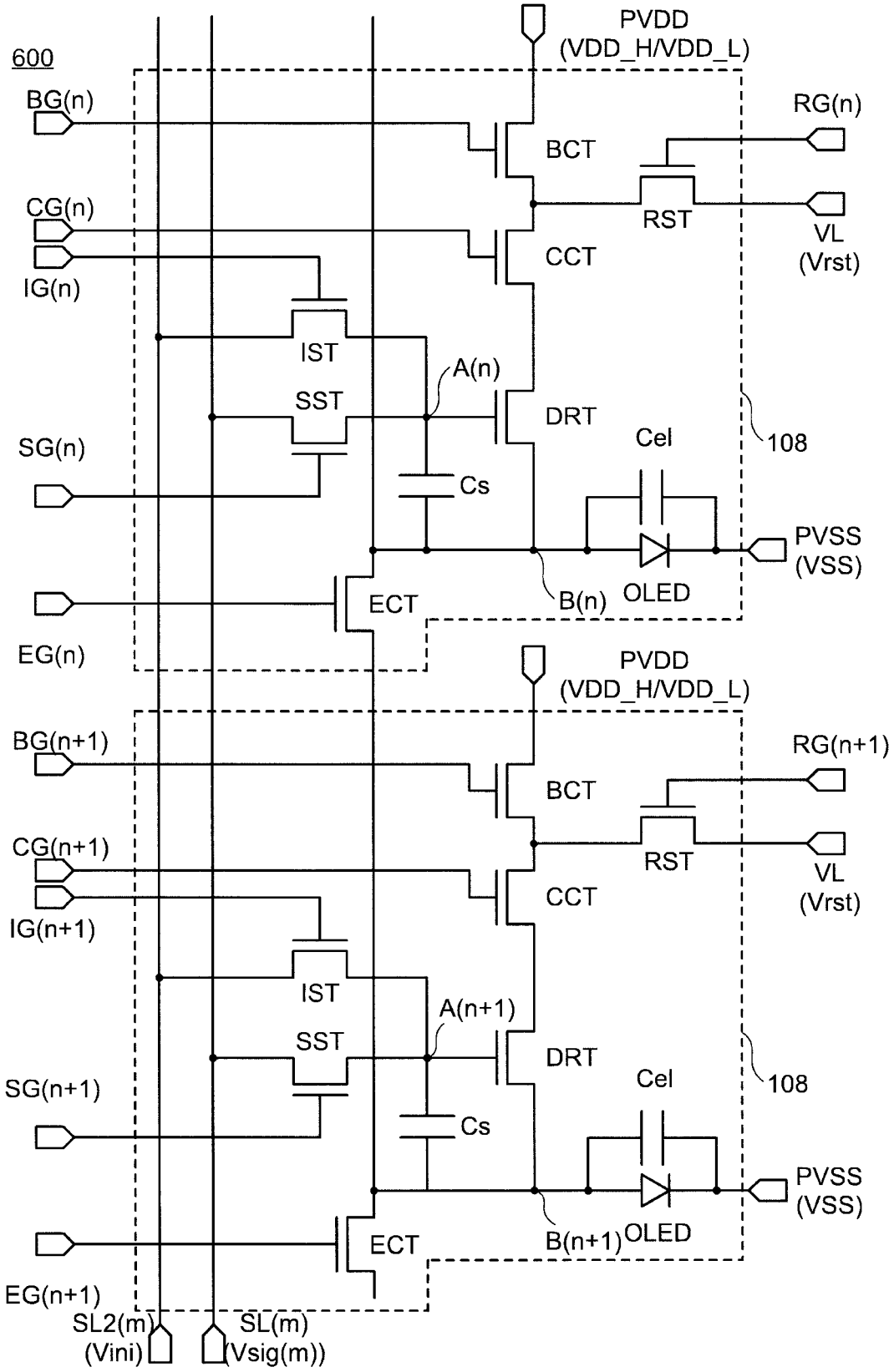
FIG. 13 is a circuit diagram of a pixel included in a display device related to one embodiment of the present invention.

FIG. 13 is a pixel circuit diagram 600 included in a display device according to one embodiment of the present invention. The pixel circuit diagram 600 shows two pixels 108 on n rows and m columns and n+1 rows and m columns arranged within the display region 106.

As is shown in FIG. 13, the pixel circuit diagram 600 shows a structure which further includes an initialization signal input transistor IST compared with the pixel circuit diagram 500 shown in FIG. 11. Similar to the explanation of FIG. 11, each transistor includes a gate and a pair of terminals (first terminal, second terminal). The capacitor element Cs includes a pair of terminals (first terminal, second terminal). The additional capacitor Cel includes a pair of terminals (first terminal, second terminal). Furthermore, although the additional capacitor Cel is shown as being separately arranged in FIG. 13, the present embodiment is not limited to this example. The additional capacitor Cel may be a parasitic capacitance or a capacitor including a parasitic capacitance.

In the structure of the pixel circuit shown in FIG. 13, the structure modified from FIG. 11 is explained. The structure other than the modification is the same as that shown in FIG. 11. In the initialization signal input transistor IST, the gate is electrically connected to an initialization signal control line SG(n), the first terminal is electrically connected to an initialization signal line SL2(*m*), and the second terminal is electrically connected to the gate of a drive transistor DRT, the second terminal of a selection transistor SST, and the first terminal of a capacitor element Cs. Similar to the pixel circuit diagram 400 shown in FIG. 9, in the pixel circuit diagram 600 shown in FIG. 13, Vini is input from the initialization signal line SL2(*m*) to the initialization signal input transistor IST. Furthermore, here, pixels on n rows and m columns are explained among the pixels 108 included in the pixel circuit. The structure of pixels on n+1 rows and m columns is the same as the pixels on n rows and m columns and n may be replaced by n+1.

Figure 14:
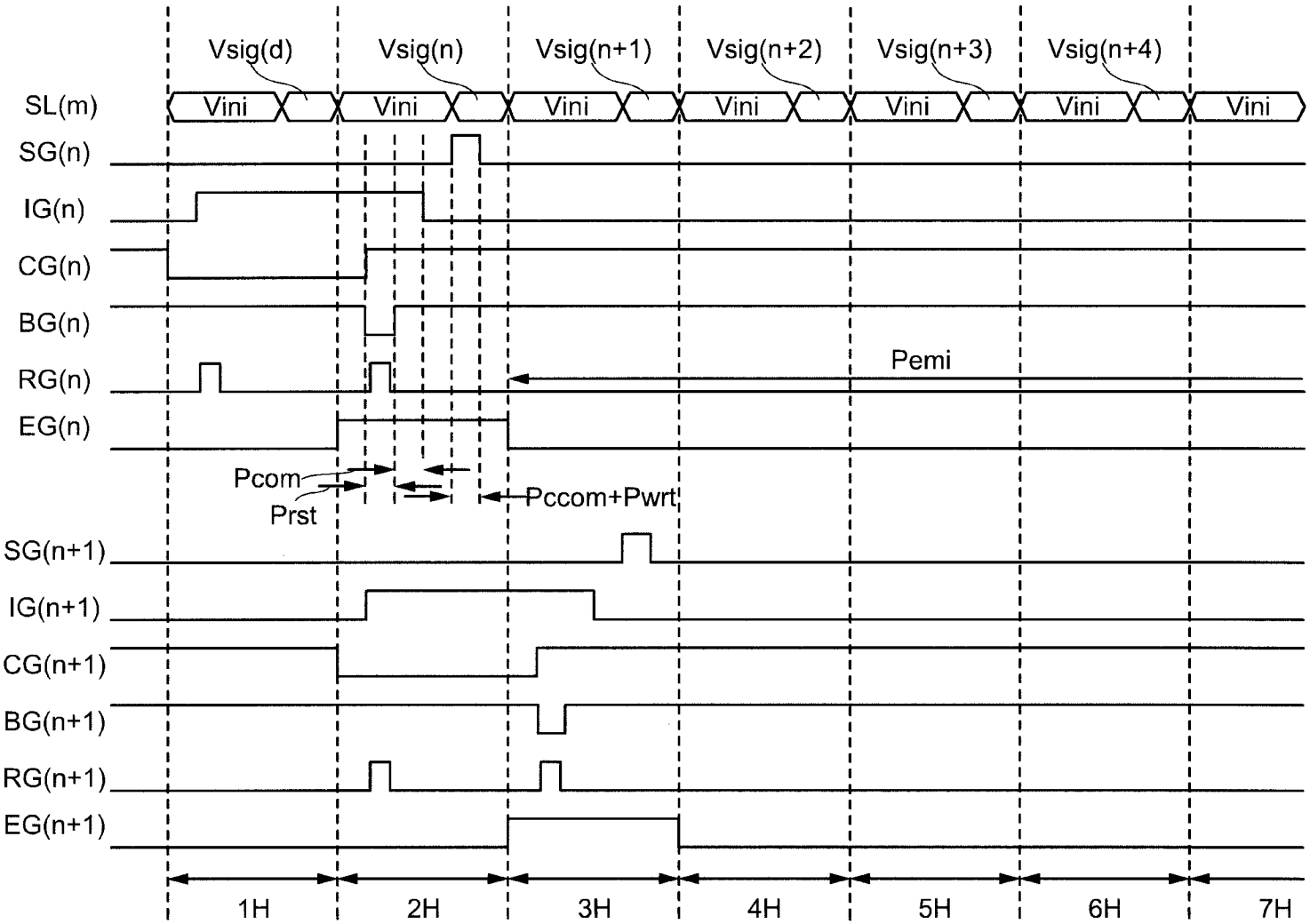
FIG. 14 is a timing chart of a pixel included in a display device related to one embodiment of the present invention.

FIG. 14 is a timing chart of pixels included in the display device according to one embodiment of the present invention and shows a time change of each signal shown in FIG. 13. A method of driving the pixel on n rows and m columns is explained below while referring to FIG. 14 and FIG. 13. Furthermore, although FIG. 14 shows a timing chart of pixels on n+1 rows and m columns, the basic operation is the same as the pixels on n rows and m columns.

Also in the method of driving the display device according to one embodiment of the present invention, a reset operation is carried out in the reset time period Prst, a threshold correction operation is carried out in the threshold correction time period Pcom, and a current correction and write operation are carried out in the current correction and the writing time period Pccom+Pwrt, and light emission is carried out in the light emitting time period Pemi the same as in the first embodiment.

The reset operation is explained. Furthermore, for example, a high level is supplied from the initialization signal control line IG(n) to the gate of the initialization signal input transistor IST on n rows and m columns, the initialization signal input transistor IST is switched on, and an operation for writing Vini to the node(n) shown in FIG. 13 may be carried out. A high level is supplied from the light emitting control signal line BG(n) to the gate of the light emitting control transistor BCT on n rows and m columns, and a high level is supplied to the gate of the light emitting control transistor BCT on n+1 rows and m columns from the light emitting control signal line BG(n+1) and both transistors may be switched on. Both of two operations may be carried out or any one of two operations may be carried out. At this time, Vini at 1H and Vsig(d) at 1H may be the same potential.

In the reset time period Prst, first, a signal which is supplied from the current correction signal line CG(n) to the gate of the current correction transistor CCT on n rows and m columns changes from a low level to a high level, and the current correction transistors CCT on n rows and m columns is switched on. When a low level signal is supplied from the scanning signal line SG(n) to the gate of the selection transistor SST on n rows and m columns, the selection transistor SST on n rows and m columns is switched off. In addition, when a low level signal is supplied from the scanning signal line SG(n+1) to the gate of the selection transistor SST on n+1 rows and m columns, the selection transistor SST on n+1 rows and m columns is switched off. When a high level signal is supplied from the initialization signal control line IG(n) to the gate of the initialization signal input transistor IST on n rows and m columns, the initialization signal input transistor IST on n rows and m columns is switched on and Vini is written to the node A(n) shown in FIG. 13. In addition, when a high level signal is supplied from the initialization signal control line IG(n+1) to the gate of the initialization signal input transistor IST on n+1 rows and m columns, the initialization signal input transistor IST on n+1 rows and m columns is switched on and Vini is written to A(n+1). Next, a low level is supplied from the light emitting control signal line BG(n) to the gate of the light emitting control transistor BCT on n rows and m columns, a low level is supplied from the light emitting control signal line BG(n+1) to the gate of the light emitting control transistor BCT on n+1 rows and m columns, and both transistors are switched off. Pixels on n rows and m columns and pixels on n+1 rows and m columns are in a dark state. In addition, when a signal which is supplied from the control line RG(n) to the gate of the initialization transistor RST on n rows and m columns changes from a low level to a high level, the initialization transistor RST on n rows and m columns is switched on and Vrst is written to the node B(n) shown in FIG. 13. Here, when the signal which is supplied from the capacitor control signal line EG(n) to the gate of the capacitor control transistor ECT on n rows and m columns changes from a low level to a high level, the capacitor control transistor ECT on n rows and m columns is switched on, the node B(n) and the node B(n+1) shown in FIG. 13 are conducting, and Vrst is written to the node B(n+1). Furthermore, at this time, the initialization transistor RST on n+1 rows and m columns may be on or off. In addition, writing Vini to the node A(n), writing Vini to the node A(n+1), and writing Vrst to the node B(n) may be carried out simultaneously.

In this way, in the reset time period Prst, the potentials of the node A(n) on n rows and the m columns and the node A(n+1) on n+1 rows and m columns are set to Vini, and the potentials of the node B(n) on n rows and m columns and the node B(n+1) on n+1 rows and m column are set to Vrst. That is, the potential between the first terminal and the second terminal of the capacitor element on n rows and m columns is set to the same potential as the potential between the first terminal and the second terminal of each capacitor element on n+1 rows and m columns. Therefore, the potential between the gate and the second terminal of the drive transistor DRT on n rows and m columns and the potential between the gate and the second terminal of the drive transistor DRT on n+1 rows and m columns can be initialized.

Next, a threshold correction operation is explained. In the threshold value correction time period Pcom following the reset time period Prst, when a signal which is supplied from the control line RG(n) to the gate of the initialization transistor RST on n rows and m columns changes from a high level to a low level, the initialization transistor RST is switched off. The selection transistor SST on n rows an m columns and the selection transistor SST on n+1 rows and m columns are both maintained in an off state. The initialization signal input transistor IST on n rows and m columns and the initialization signal input transistor IST on n+1 rows and m columns are both maintained in an on state, and the potentials of the node A(n) and the node A(n+1) are maintained at Vini.

The capacity control transistor ECT on n rows and m columns is maintained in an on state, and the potentials of the node B(n) and the node B(n+1) are maintained at Vrst. The current correction transistor CCT on n rows and m columns is maintained in an on state. When a high level is supplied from the light emitting control signal line BG(n) to the gate of the light emitting control transistor BCT on n rows and m columns, the light emitting control transistor BCT on n rows and m columns is switched on. When the light emitting control transistor BCT on n rows and m columns is switched on, VDD_H is supplied from the high potential power supply wiring PVDD to the drive transistors DRT on n rows and m columns via the light emitting control transistor BCT. As a result, a current flows to the drive transistor DRT on n rows and m columns, and the potential of the node B(n) shifts from Vrst to the high potential side. When the potential difference between the node A(n) and the node B(n) becomes the same as the threshold voltage Vthn of the drive transistor DRT on n rows and m columns, that is, when the potential of node B(n) becomes Vini−Vthn, a current no longer flows to the drive transistor DRT on n rows and m columns. At this time, the potential of the node B(n+1) becomes Vini−Vthn which is the same as the potential of the node B(n). In this way, the threshold voltage Vthn of the drive transistor DRT of n rows and m columns is held between the first and second terminals of the capacitor element on n rows and m columns, and between the first and second terminals of each capacitor element on n+1 rows and m columns.

In this way, in the threshold value correction time period Pcom, it is possible to hold a threshold voltage Vthn of a drive transistor on n rows and m columns between the first terminal and the second terminal of the capacitor element Cs on n rows and m columns, and the first terminal and the second terminal of the capacitor element Cs on n+1 rows and m columns. In this way, it is possible to correct the threshold value of the drive transistor DRT the same as was explained in the first embodiment.

Next, the current correction and write operation are explained. First, the operation between the threshold correction time period Pcom and the current correction and write time period Pccom+Pwrt is explained. The selection transistor SST on n rows and m columns and the selection transistor SST on n+1 rows and m columns are both maintain tin an off state. The initialization signal input transistor IST on n+1 rows and m columns is maintained in an on state. When a signal supplied which is from the initialization signal control line IG(n) to the gate of the initialization signal input transistor IST on n rows and m columns changes from a high level to a low level, the initialization signal input transistor IST on n rows and m columns is switched off. The light emitting control transistor BCT on n rows and m columns is maintained in an on state. The light emitting control transistor BCT of n+1 rows and m columns is maintained in an on state. The initialization transistor RST is maintained in an off state. The capacitor control transistor ECT of n rows and m columns is maintained in an on state. At this time, the potentials of the node B(n) and the node B(n+1) are maintained at Vini−Vthn. The current correction transistor CCT on n rows and m columns is maintained in an on state.

Next, the current correction and write operation is explained. In the current correction and writing time period Pccom+Pwrt, the current correction transistor CCT of n rows and m columns is maintained in an on state. Since the remainder of the driving method is the same as that shown in FIG. 12, an explanation is omitted here. The potentials of the node B(n) and the node B(n+1) are expressed in the formula (1) shown previously by capacitive coupling via the capacitor element Cs included in a pixel of n rows and m columns. In addition, a potential difference (gate/source voltage) between the gate and the second terminal of the drive transistor DRT on n rows and m columns, that is, the potential difference between the node A(n) and the node B(n) is expressed in the formula (2) down previously. Furthermore, the current Id which flows from the first terminal to the second terminal of the drive transistor DRT on n rows and m columns is expressed in the formula (4) shown previously and does not depend on the threshold of the drive transistor DRT. In addition, in the display device according to one embodiment of the present invention, the same as in the first embodiment, even if the mobility μ of the drive transistor DRT included in each of the plurality of pixels 108 varies, it is possible to remove a variation in mobility μ when the light emitting element OLED arranged in each of the plurality of pixels 108 emits light.

As described above, in the current correction and writing time period Pccom+Pwrt, it is possible to write a video signal and correct the current of the driving transistor DRT.

Lastly, the operation of the light emitting time period Pemi is explained. In the light emitting period Pemi, the current correction transistor CCT on n rows and m columns is maintained in an on state. The initialization signal input transistor IST on n+1 rows and m columns is maintained in an on state. The initialization signal input transistor IST on n rows and m columns is maintained in an off state. The remainder of the driving method is the same as in FIG. 12. The node B(n) and the node B(n+1) are separated by switching off the capacitor control transistor ECT. Following this, light emission of the light emitting element OLED on n rows and m columns begins. The light emitting current at this time is expressed in the formula (4) shown previously.

In the pixel circuit diagram 600 shown in FIG. 13, an initialization signal input transistor IST is added compared with the pixel circuit diagram 500 shown in FIG. 11. The display device according to one embodiment of the present invention can control the initialization signal input transistor IST and the selection transistor SST independently of each other. As a result, the write operation and the initialization operation can be made clear. In addition, by arranging the capacitor control transistor ECT in the display device according to one embodiment of the present invention, it is possible to increase the maximum value of the light emitting current which can flow, and it is possible to realize a high dynamic range. In the display device according to one embodiment of the present invention, since initialization is carried out clearly by the initialization signal input transistor IST, it is possible to carry out a threshold correction and current correction of the drive transistor with high accuracy. Therefore, a high definition display device with high display quality can be provided by the display device and driving method according to one embodiment of the present invention.

In addition, although an example in which one light emitting control transistor BCT is arranged in one pixel is shown in FIG. 13, a plurality of adjacent light emitting control transistors BCT on the same row may be shared. For example, one light emitting control transistor BCT may be shared by three adjacent sub-pixels on the same row. Furthermore, although an example in which one initialization transistor RST is arranged in one pixel is shown in FIG. 13, one initialization transistor RST may be arranged in one column. In the display device according to one embodiment of the present invention, by sharing transistors, it is possible to reduce the number of transistors per pixel and the pixel layout can be reduced. In addition, in the display device according to one embodiment of the present invention, in the case when the pixel area is the same as a conventional pixel area, it is possible to increase a storage capacitor and an additional capacitor. As a result, the display device according to the embodiment of one present invention can increase the maximum value of the light emitting current which can be flow and it is possible to take a wide dynamic range. Therefore, a high definition display device with high gradation and high luminosity can be provided by the display device according to one embodiment of the present invention.

Sixth Embodiment

In the present embodiment, a cross-sectional structure (film formation structure) of a pixel 108 included in the display device according to one embodiment of the present invention is explained.

Figure 15:
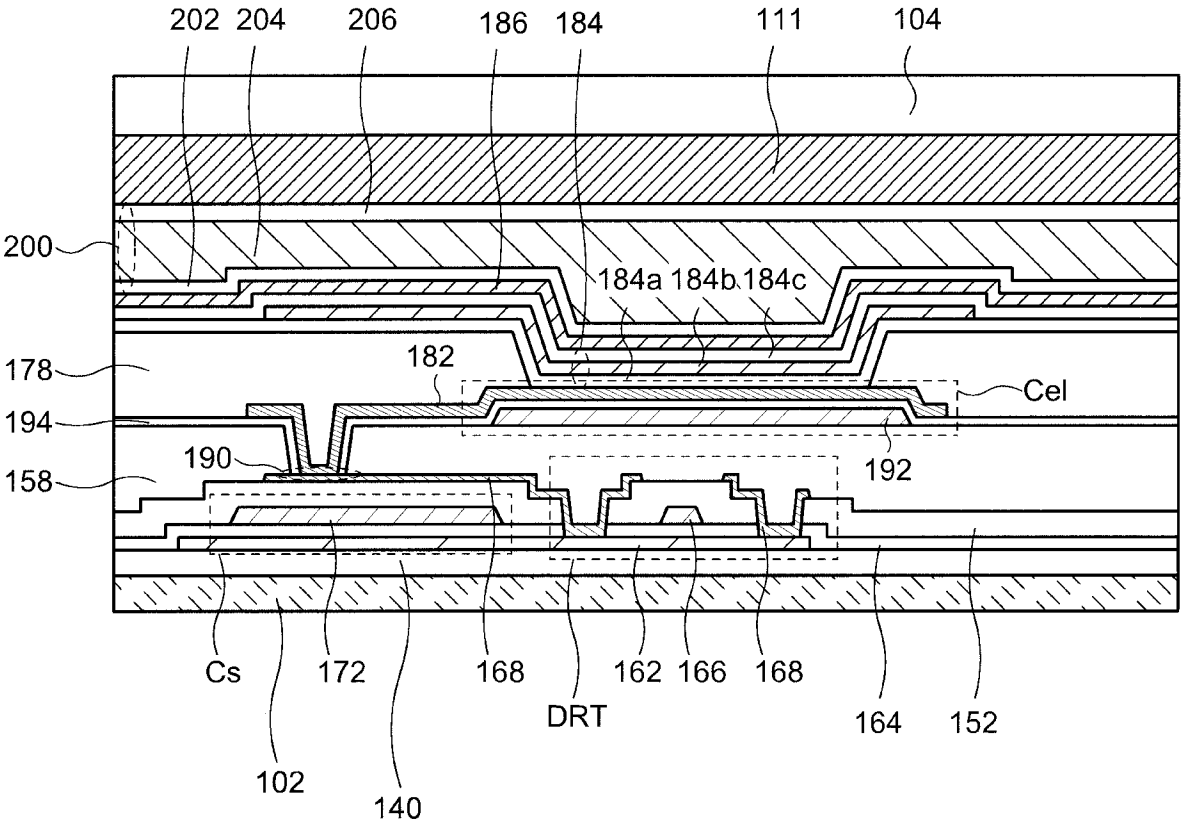
FIG. 15 is a schematic cross-sectional diagram of a pixel included in a display device related to one embodiment of the present invention.

FIG. 15 is a schematic cross-sectional diagram of the pixel 108 included in the display device 100. More specifically, FIG. 15 shows a schematic cross-sectional structure (film formation structure) of a capacitive element Cs, the drive transistor DRT, the additional capacitor Cel and the light emitting element OLED included in the pixel 108.

The display device 100 includes a drive transistor DRT and a capacitor element Cs above a first substrate 102 via an underlayer film 140 which has an arbitrary structure. The underlying film 140 is formed from, for example, silicon nitride, silicon oxide, or stacked layers of silicon nitride and silicon oxide. The drive transistor DRT includes a semiconductor film 162, a gate insulating film 164, a gate electrode 166 and a source or drain electrode 168. A region of the semiconductor film 162 which overlaps the gate electrode 166 is a channel region, and the channel region is sandwiched by a pair of sources or drain regions. The source or drain electrode 168 is electrically connected to the source or drain region via an opening arranged in the interlayer film 152 and the gate insulating film 164. The semiconductor film 162 extends below an electrode 172 of a storage capacitor. The capacitor element Cs is formed by the semiconductor film 162, the electrode 172 of the storage capacitor, and the gate insulating film 164 sandwiched therebetween. The structural components which form the capacitor element Cs are not limited to those described above. For example, the capacitor element Cs may also be formed by facing the electrode 172 of the storage capacitor against the pixel electrode of the light emitting element OLED interposed therebetween by an insulating film.

A first planarization film 158 is arranged above the driving transistor DRT and the capacitor element Cs which absorbs unevenness due to these and provides a flat surface. The first planarization film 158 is arranged with an opening 190 which reaches the source or drain electrode 168. The source or drain electrode 168 and the pixel electrode (first electrode 182 described later) of the light emitting element OLED are electrically connected at the opening 190.

An additional capacitor electrode 192 is arranged the first planarization film 158. A capacitor insulating film 194 is formed to cover the additional capacitor electrode 192 and the first planarization film 158. The additional capacitor electrode 192 forms the additional capacitor Cel together with the capacitor insulating film 194 and the first electrode 182 of the light emitting element OLED formed thereon, and contributes to a reduction in the variation of light emission of the light emitting element OLED. The structural components which form the additional capacitor Cel are not limited to those described above. For example, the additional capacitor Cel may be a parasitic capacitance of the light emitting element OLED.

The light emitting element OLED is formed by a first electrode 182 (also called a pixel electrode), a second electrode 186 (also called a common electrode), and an EL layer 184 (also called an organic layer) arranged therebetween. A second planarization film 178 (also called a bank or a partition wall) is arranged above the first electrode 182 to both expose a part of the first electrode 182 and to cover the periphery part of the first electrode 182. The second planarization film 178 is located at a boundary between a plurality of pixels (or sub-pixels) across the entire surface of the display region 106 shown in FIG. 1. That is, the second planarization film 178 demarcates a plurality of pixels (or sub-pixels). The EL layer 184 is formed to cover the first electrode 182 and the second planarization film 178, and a second electrode 186 is arranged thereon. The second electrode 186 is located across a plurality of pixels. Carriers (electrons, holes) are injected into the EL layer 184 from the first electrode 182 and the second electrode 186, and carrier recombination occurs within the EL layer 184. In this way, an excited state of an organic compound included within the EL layer 184 is formed, and the energy which is released when the excited state relaxes to the ground state is used as light emission. Therefore, a region where the EL layer 184 and the first electrode 182 contact with each other is a light emitting region.

In FIG. 15, the EL layer 184 has three layers, that is, a hole transport layer 184*a*, a light emitting layer 184*b* and an electron transport layer 184*c*. The hole transport layer 184*a* and the electron transport layer 184*c* are located across a plurality of pixels. The layer structure of the EL layer 184 is not limited to tat described above and four or more layers may be stacked. The EL layer 184 may further include, for example, a hole injection layer or an electron injection layer.

A sealing film 200 (also called a passivation film or a protective film) for protecting a light emitting element OLED may be arranged above the light emitting element OLED. For example, as is shown in FIG. 15, the sealing film 200 may have a structure in which an organic film 204 including an organic compound is sandwiched between two inorganic films (first inorganic film 202, second inorganic film 206) including an inorganic compound.

The second substrate 104 is arranged above the sealing film 200 interposed by the filler 111 therebetween. The sealing film 200 and elements arranged below the sealing film 200 are protected by the second substrate 104. The filler 111 and the second substrate 104 may be omitted. Instead of the second substrate 104, a structure is possible in which a flexible film (protective film) or a circularly polarizing plate may be attached to the sealing film 200.

By forming the pixel 108 as described above and arranging the pixel circuit explained in the first to fifth embodiments, it is possible to widen a dynamic range and provide a high definition display device with a large light emitting current. Furthermore, the structure of the pixel 108 is not limited to the structure shown in FIG. 15. For example, it is possible to arrange the capacitor element Ca in a different position to that shown in FIG. 15.

Each embodiment described above as embodiments of the present invention can be implemented in combination as appropriate as long as they do not contradict each other. In addition, those skilled in the art could appropriately add, delete or change the design of the constituent elements based on the display device of each embodiment, or add, omit or change conditions as long as it does not depart from the concept of the present invention and such changes are included within the scope of the present invention.

Although an electroluminescence display device is mainly exemplified in the present specification as a disclosed example, other display devices in which a pixel includes a storage capacitor can also be applied. In addition, the size of the display device exemplified in the present specification can be applied from a medium to small size to a large size without any particular limitation.

Even if other actions and effects different from the actions and effects brought about by the aspects of each embodiment described above are obvious from the description of the present specification or those which could be easily predicted by those skilled in the art, such actions and effects are to be interpreted as being provided by the present invention.

What is claimed is:

1. A display device comprising:

a first pixel having a first light emitting element including a first pixel electrode and a common electrode, and a drive transistor having an input/output terminal, one end of the input/output terminal being connected to the first pixel electrode;

a second pixel adjoining the first pixel, and having a second light emitting element including a second pixel electrode and the common electrode; and first switches including a first switch of the first pixel, wherein the first pixel electrode and the second pixel electrode are connected via the first switch of the first pixel, the first switch of the first pixel is ON when a video signal is written to the first pixel, and the first light emitting element and the second light emitting element are connected in parallel.

2. The display device according to claim 1, wherein a first capacitor is connected in parallel with the first light emitting element, a second capacitor is connected in parallel with the second light emitting element, the first capacitor includes a first electrode connected with the first pixel electrode, the second capacitor includes a second electrode connected with the second pixel electrode, and the first electrode and the second electrode are connected via the first switch of the first pixel.

3. The display device according to claim 1, further comprising a first switch of the second pixel included in the first switches; and a third pixel adjoining the second pixel and arranged with a third light emitting element having a third pixel electrode and the common electrode, wherein the second pixel electrode and the third pixel electrode are connected via the first switch of the second pixel.

4. The display device according to claim 3, wherein the first pixel, the second pixel and the third pixel are mutually connected by connecting the first pixel electrode, the second pixel electrode and the third pixel electrode via the first switches.

5. A display device comprising:

a first pixel having a first light emitting element including a first pixel electrode and a common electrode, and a drive transistor having an input/output terminal, one end of the input/output terminal being connected to the first pixel electrode;

a second pixel adjoining the first pixel, and having a second light emitting element including a second pixel electrode and the common electrode; and first switches including a first switch of the first pixel, wherein the first pixel electrode and the second pixel electrode are connected via the first switch of the first pixel, the first pixel includes a second switch, a capacitor element arranged with a pair of electrodes, a third switch, a fourth switch, a fifth switch and a power supply line, a first terminal of the second switch is electrically connected with a gate of the drive transistor, a first electrode of the capacitor element is electrically connected with the gate of the drive transistor, a second electrode of the capacitor element is electrically connected with the first pixel electrode, a first terminal of the third switch is electrically connected with the first terminal of the second switch, the first electrode of the capacitor element, and the gate of the drive transistor, a first terminal of the fourth switch is electrically connected with the second electrode of the capacitor element and the first pixel electrode, a first terminal of the fifth switch is electrically connected with the power supply line, and a second terminal of the fifth switch is electrically connected with a second input/output terminal of the drive transistor.

6. The display device according to claim 5, wherein the first pixel includes a sixth switch located between the drive transistor and the fifth switch, a first terminal of the sixth switch is electrically connected with the first terminal of the fourth switch and the second terminal of the fifth switch, a second terminal of the sixth switch is electrically connected with the second input/output terminal of the drive transistor, and the first terminal of the fourth switch is electrically connected with the second electrode of the capacitor element and the first pixel electrode via the sixth switch and the drive transistor.

7. The display device according to claim 5, wherein the first pixel includes a fourth switch, a fifth switch, a sixth switch and a power supply line, a first terminal of the fifth switch is electrically connected with the power supply line, a second terminal of the fifth switch is electrically connected with the first terminal of the fourth switch and a first terminal of the sixth switch, and a second terminal of the sixth switch is electrically connected with the second input/output terminal of the drive transistor.

* * * * *